US009255753B2

(12) United States Patent
Pulkrabek et al.

(10) Patent No.: US 9,255,753 B2
(45) Date of Patent: Feb. 9, 2016

(54) ENERGY STORAGE DEVICE FOR A BOW

(71) Applicant: RAVIN CROSSBOWS, LLC, Superior, WI (US)

(72) Inventors: Larry Pulkrabek, Osceola, IA (US); Jay Engstrom, Port Wing, WI (US); Craig Thomas Yehle, Holmen, WI (US); Aaron Pellett, Alborn, MN (US); Matthew P. Haas, Duluth, MN (US); Fred H. Hunt, Duluth, MN (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 265 days.

(21) Appl. No.: 13/799,518

(22) Filed: Mar. 13, 2013

(65) Prior Publication Data

US 2014/0261358 A1 Sep. 18, 2014

(51) Int. Cl.

| | |
|---|---|
| ***F41B 5/12*** | (2006.01) |
| ***F41B 5/10*** | (2006.01) |
| ***F41B 5/14*** | (2006.01) |

(52) U.S. Cl.

CPC ..... *F41B 5/105* (2013.01); *F41B 5/123* (2013.01); *F41B 5/1469* (2013.01); *Y10T 29/49826* (2015.01)

(58) Field of Classification Search

CPC ..... F41B 5/105; F41B 5/123; F41B 5/0094; F41B 5/12; F41B 5/00

See application file for complete search history.

(56) References Cited

U.S. PATENT DOCUMENTS

| | | | |
|---|---|---|---|
| 4,030,473 | A | 6/1977 | Puryear |
| 4,192,281 | A | 3/1980 | King |
| 4,287,867 | A | 9/1981 | Islas |
| 4,479,480 | A | 10/1984 | Holt |
| 4,545,358 | A | 10/1985 | Collins |
| 4,565,182 | A | 1/1986 | Barnett |
| 4,587,944 | A | 5/1986 | Barnett |
| 4,693,228 | A | 9/1987 | Simonds et al. |
| 4,719,897 | A | 1/1988 | Gaudreau |
| 4,766,874 | A | 8/1988 | Nishioka |
| 4,877,008 | A | 10/1989 | Troubridge |
| 4,942,861 | A | 7/1990 | Bozek |
| 5,085,200 | A | 2/1992 | Horton-Corcoran et al. |
| 5,220,906 | A | 6/1993 | Choma |
| D337,145 | S | 7/1993 | Horton-Corcoran |
| 5,243,956 | A | 9/1993 | Luehring |
| 5,265,584 | A | 11/1993 | Judson et al. |
| 5,388,564 | A | 2/1995 | Islas |
| 5,445,139 | A | 8/1995 | Bybee |
| 5,522,373 | A | 6/1996 | Barnett |
| 5,596,976 | A | 1/1997 | Waiser |
| 5,598,829 | A | 2/1997 | Bednar |
| 5,630,405 | A | 5/1997 | Nizov |
| 5,649,520 | A | 7/1997 | Bednar |
| 5,884,614 | A | 3/1999 | Darlington et al. |
| 6,073,351 | A | 6/2000 | Barnett |
| 6,095,128 | A | 8/2000 | Bednar |

(Continued)

*Primary Examiner* — Melba Bumgarner
*Assistant Examiner* — Amir Klayman

(57) ABSTRACT

An energy storage portion for a bow and a method of configuring the same. At least one first limb has both a distal portion and a proximal portion coupled to the first side of a center support. At least one second limb has both a distal portion and a proximal portion coupled to the second side of the center support. At least one first pulley is attached to the first limb at a location between the distal and the proximal portions of the first limb and at least one second pulley is attached to the second limb at a location between the distal and the proximal portions of the second limb.

20 Claims, 22 Drawing Sheets

(56) References Cited

U.S. PATENT DOCUMENTS

| | | | |
|---|---|---|---|
| 6,205,990 | B1 | 3/2001 | Adkins |
| 6,286,496 | B1 | 9/2001 | Bednar |
| 6,425,386 | B1 | 7/2002 | Adkins |
| 6,571,785 | B1 | 6/2003 | Choma |
| 6,651,641 | B1 | 11/2003 | Bower et al. |
| 6,705,304 | B1 | 3/2004 | Pauluhn |
| 6,712,057 | B2 | 3/2004 | Andrews |
| 6,736,123 | B1 | 5/2004 | Summers et al. |
| 6,776,148 | B1 | 8/2004 | Islas |
| 6,786,214 | B2 | 9/2004 | Andrews |
| 6,799,566 | B1 | 10/2004 | Malucelli |
| 6,901,921 | B1 | 6/2005 | Barnett |
| 6,913,007 | B2 | 7/2005 | Bednar |
| 7,174,884 | B2 | 2/2007 | Kempf et al. |
| 7,204,242 | B2 | 4/2007 | Dziekan |
| 7,305,979 | B1 | 12/2007 | Yehle |
| 7,328,693 | B2 | 2/2008 | Kempf |
| 7,363,921 | B2 | 4/2008 | Kempf |
| D589,578 | S | 3/2009 | Choma |
| D590,907 | S | 4/2009 | Barnett |
| 7,624,724 | B2 | 12/2009 | Bednar et al. |
| 7,624,725 | B1 | 12/2009 | Choma |
| 7,677,233 | B2 | 3/2010 | Bednar |
| 7,708,001 | B2 | 5/2010 | Kempf |
| 7,743,760 | B2 | 6/2010 | Woodland |
| 7,748,370 | B1 | 7/2010 | Choma |
| 7,770,567 | B1 | 8/2010 | Yehle |
| 7,810,480 | B2 | 10/2010 | Shepley et al. |
| 7,836,871 | B2 | 11/2010 | Kempf |
| 7,997,258 | B2 | 8/2011 | Shepley et al. |
| 8,016,703 | B1 | 9/2011 | Kronengold et al. |
| 8,020,543 | B2 | 9/2011 | Maleski et al. |
| 8,033,275 | B2 | 10/2011 | Bednar et al. |
| 8,042,530 | B2 | 10/2011 | Barnett |
| 8,091,540 | B2 | 1/2012 | Matasic et al. |
| 8,104,461 | B2 | 1/2012 | Kempf |
| 8,240,299 | B2 | 8/2012 | Kronengold et al. |
| 8,651,095 | B2 | 2/2014 | Islas |
| 8,899,217 | B2 | 12/2014 | Islas |
| 2005/0022799 | A1 | 2/2005 | Bednar |
| 2007/0028907 | A1 | 2/2007 | Bednar et al. |
| 2009/0178657 | A1 | 7/2009 | Shaffer |
| 2009/0194086 | A1 | 8/2009 | Kempf |
| 2009/0223500 | A1* | 9/2009 | Stanziale ..... 124/25 |
| 2010/0012108 | A1 | 1/2010 | Bednar et al. |
| 2010/0031945 | A1 | 2/2010 | Shaffer et al. |
| 2010/0154768 | A1 | 6/2010 | Bednar et al. |
| 2010/0170487 | A1 | 7/2010 | Kronengold et al. |
| 2010/0170488 | A1 | 7/2010 | Rasor et al. |
| 2010/0186728 | A1 | 7/2010 | Bednar et al. |
| 2010/0269807 | A1 | 10/2010 | Kempf |
| 2011/0203561 | A1 | 8/2011 | Shaffer et al. |
| 2011/0232619 | A1 | 9/2011 | Bednar et al. |
| 2011/0253118 | A1 | 10/2011 | Kempf |
| 2012/0006311 | A1 | 1/2012 | Bednar et al. |

* cited by examiner

ENERGY STORAGE DEVICE FOR A BOW

FIELD OF THE INVENTION

The present disclosure is directed to an energy storage portion for a bow with limbs having distal portions and proximal portions both coupled to a center support. The present disclosure is also directed to a pulley system in which only the draw string crosses over the center support.

BACKGROUND OF THE INVENTION

Bows have been used for many years as a weapon for hunting and target shooting. More advanced bows include cams that increase the mechanical advantage associated with the draw of the bowstring. The cams are configured to yield a decrease in draw force near full draw.

For optimal bow performance, substantial synchronization of rotation of the cams is required, but often problematic to achieve in practice. Synchronization typically requires secondary strings and pulleys that control the rotation of the cams, such as disclosed in U.S. Pat. No. 7,305,979 (Yehle). These additional features increase the weight, cost and maintenance of such devices, while adding additional friction, further decreasing the potential speed of the projectile.

BRIEF SUMMARY OF THE INVENTION

The present disclosure is directed to an energy storage portion for a bow with limbs having distal portions and proximal portions both coupled to a center support. The present disclosure is also directed to a pulley system in which only the draw string crosses over the center support.

One embodiment is directed to an energy storage portion for a bow including a center support having a first side and a second side. At least one first limb has both a distal portion and a proximal portion coupled to the first side of the center support. At least one second limb has both a distal portion and a proximal portion coupled to the second side of the center support. At least one first pulley is attached to the first limb at a location between the distal and the proximal portions of the first limb and at least one second pulley is attached to the second limb at a location between the distal and the proximal portions of the second limb.

The distal portions and the proximal portions of the first and second limbs can be dynamically coupled or positively coupled to the center support. In one embodiment, the distal portions or the proximal portions dynamically coupled to the center support do not contact the center support until the limbs are deformed inward toward the center support.

The distal portions and/or the proximal portions of the first and second limbs can be coupled to the center support by a rigid coupling, a pivoting coupling, a linkage coupling, a rotating coupling, a sliding coupling, an elastomeric coupling, or a combination thereof. At least one of the couplings preferably provides limb relief between the proximal portion and the distal portion of the limbs. In another embodiment, the center support provides limb relief between the proximal portion and the distal portion of the limbs.

In another embodiment, at least one of the distal portions or the proximal portions of the first and second limbs are positively coupled to the center support by rotating translation arms. The rotation of the rotating translation arms is synchronized by a synchronization assembly.

A draw string extends across the center support and around portions of the first and second pulleys. In one embodiment, the draw string includes a first end secured to the first pulley and a second end secured to the second pulley. The first and second pulleys are displaced toward the center support as the draw string is pulled to a drawn configuration. In another embodiment, the first and second ends of the draw string can be coupled to the center support.

The total displacement of the first pulley axis toward the second pulley axis as the draw string is pulled to a drawn configuration is preferably less than about 3.5 inches, or about 3.0 inches. In another embodiment, separation between the first and second axes when the draw string is in a drawn configuration is less than about 10 inches and less than about 13 inches when the draw string is in the released configuration.

In one embodiment, a first power string has a first end attached to the center support and a second end attached to the first pulley, and a second power string with a first end attached to the center support and a second end attached to the second pulley. The first and second power strings preferably do not cross over the center support from the first side to the second side.

In another embodiment, the first and second limbs each include a pair of limbs arranged in a spaced apart configuration with the first and second pulleys located between the pair of limbs, respectively. The first and second limbs can be arranged in a concave or convex configuration with respect to the center support. The first and second pulleys are preferably cams. The first and second pulleys are preferably coupled to the limbs generally at a midpoint between the distal and proximal portions.

The present disclosure is also directed to a method of configuring an energy storage portion for a bow. A distal portion and a proximal portion of at least a first limb are coupled to the first side of the center support. A distal portion and a proximal portion of at least a second limb are coupled to the second side of the center support. At least one first pulley is attached to the first limb at a location between the distal and the proximal portions of the first limb and at least one second pulley is attached to the second limb at a location between the distal and the proximal portions of the second limb.

The present disclosure is also directed to a pulley system for an energy storage portion of a bow. The pulley system includes a center support having a first side and a second side. At least one first limb has at least one of a distal portion and a proximal portion coupled to the first side of the center support, and at least one second limb has at least one of a distal portion and a proximal portion coupled to the second side of the center support. At least one first pulley is attached to the first limb and at least one second pulley is attached to the second limb. A draw string extends across the center support and around portions of the first and second pulleys. The draw string includes a first end secured to the first side of the center support and a second end secured to the second side of the center support.

The present disclosure is also directed to a pulley system for an energy storage portion of a bow including a draw string extending across the center support and around portions of the first and second pulleys. The draw string includes a first end secured to the first pulley and a second end secured to the second pulley. A first power string has a first end attached to the center support and a second end attached to the first pulley. A second power string has a first end attached to the center support and a second end attached to the second pulley, whereby the first and second power strings do not cross over the center support from the first side to the second side.

DETAILED DESCRIPTION OF THE INVENTION

FIGS. 1-4 are perspective views of an energy storage device 50 for a projectile launching system in accordance with an embodiment of the present disclosure. Center support 52 includes a first pair of distal and proximal limb mounts 54A, 56A located on a first side 58A of center plane 60 and a second pair of distal and proximal limb mounts 54B, 56B located on a second side 58B on the second side of the center plane 60.

The center support 52 can be a single piece or a multi-component construction. In the illustrated embodiment, the center support 52 includes a pair of machined center rails 52A, 52B coupled together with fasteners, and a pair of finger guards 53A, 53B also attached to the center rails 52A, 52B using fasteners. The components 52, 53 are preferably constructed from a light weight metal, such as high grade aluminum. As will be discussed below, the center support 52 will include a variety of additional features, such as cut-outs and mounting holes, to accommodate other components such as a trigger mechanism, cocking mechanism, stock, arrow storage, and the like (see e.g., FIG. 12B).

Figure 3:
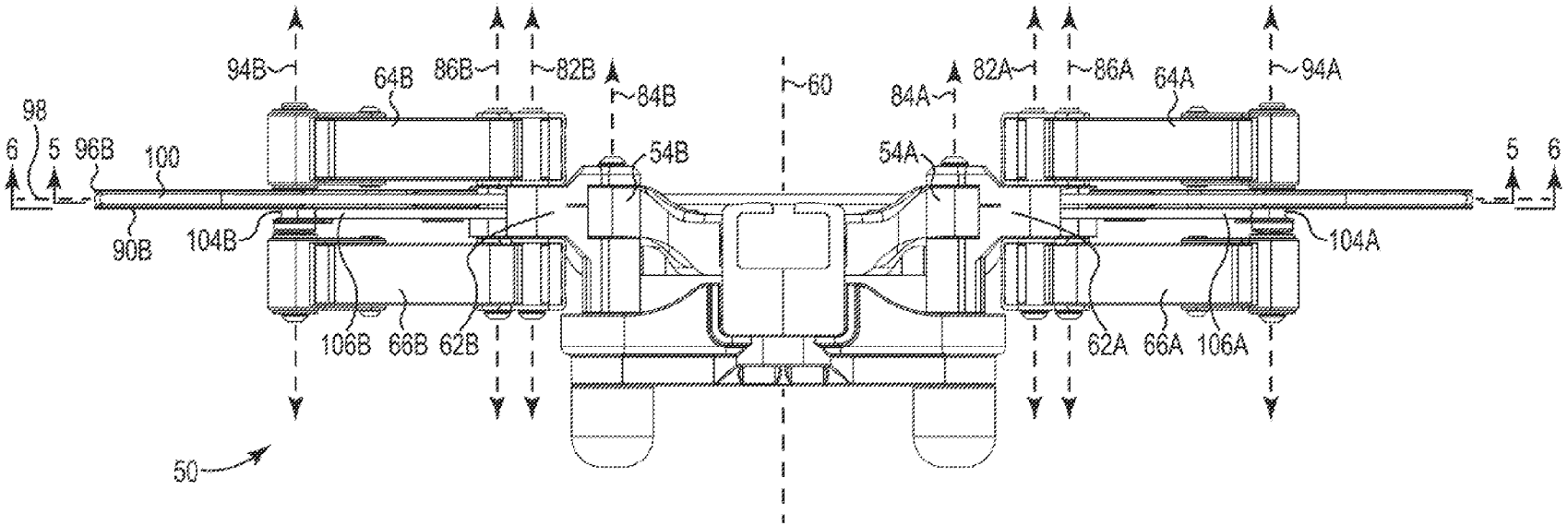
FIG. 3 is a front view of the energy storage system of FIG. 1.
Figure 4:
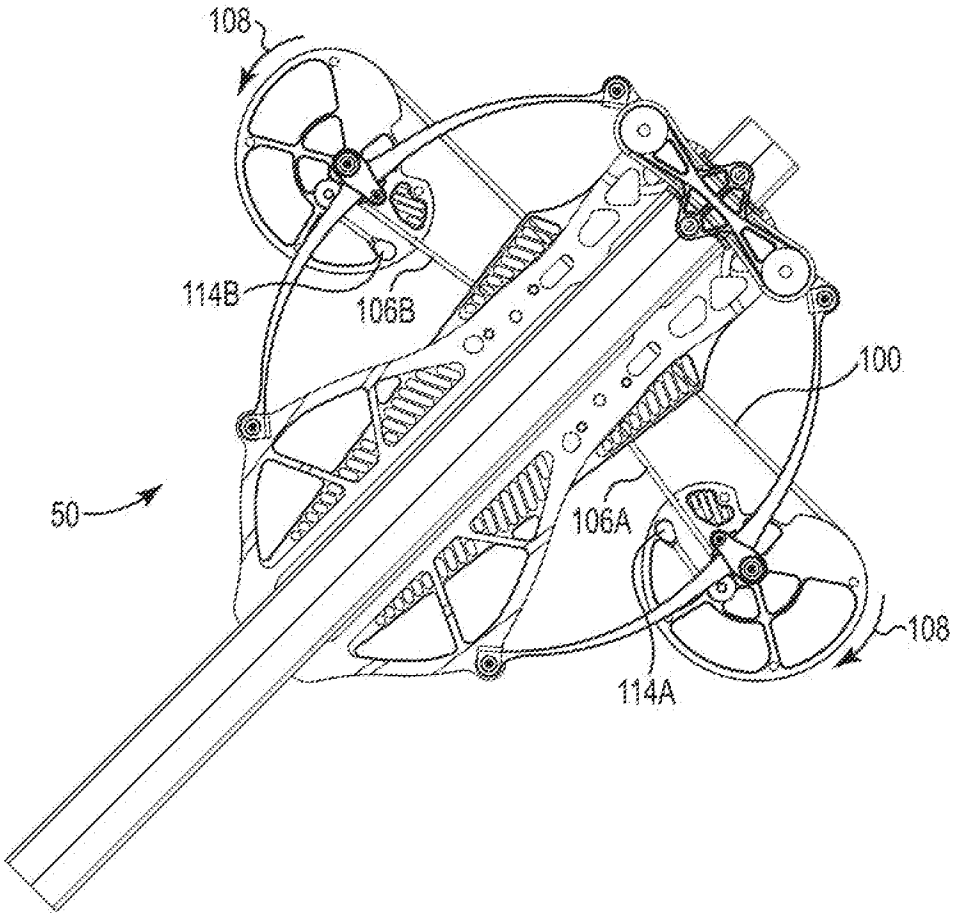
FIG. 4 is a bottom view of the energy storage system of FIG. 1.

In the illustrated embodiment, limbs 64A, 66A are located on first side 58A of the center plane 60 and limbs 64B, 66B are located on the second side 58B. Proximal portions 68A, 68B ("68") of the limbs 64A, 66A are coupled to the proximal limb mount 54A in the finger guard 53A, such as by pivot pin 70 and pivot brackets 72. Proximal portions 74A, 74B ("74") of the limbs 64B, 66B are coupled to the proximal limb mounts 56B in the finger guard 53B by pivot pin 70 and pivot brackets 72. As illustrated in FIG. 3, the proximal portions 68, 74 rotate on axes 86A, 86B ("86") relative to the center support 52 to provide a pivoting or rotating coupling.

In the illustrated embodiment, translation arms 62A, 62B ("62") are pivotally attached to the distal limb mounts 54A, 54B in the finger guards 53A, 53B, respectively. Distal portions 76A, 76B ("76") of the limbs 64A, 66A are coupled to the translation arm mount 78A, such as by pivot pin 70 and pivot brackets 72. Distal portions 80A, 80B ("80") of the limbs 64B, 66B are coupled to the translation arm mount 78B by pivot pin 70 and pivot brackets 72. The distal portions 76, 80 rotate on axes 82A, 82B, ("82") relative to the translation arm mounts 78A, 78B, respectively. The translation arms 62A, 62B rotate on axes 84A, 84B ("84"), respectively, relative to the center support 52 (see, FIG. 3). The translation arms 62 to provide a linkage coupling between the limbs 64, 66 and the center support 52.

As used herein, "coupled" or "coupling" refers to a connection between a limb and a center support. Both positive coupling and dynamic coupling are possible. "Positively coupled" or "positive coupling" refers to a limb continuously engaged with a center support. "Dynamically coupled" or "dynamic coupling" refers to a limb engage with a center support only when a certain level of tension is applied to a draw string. The coupling can be a rigid coupling, a sliding coupling, a pivoting coupling, a linkage coupling, a rotating coupling, an elastomeric coupling, or a combination thereof.

Figure 1:
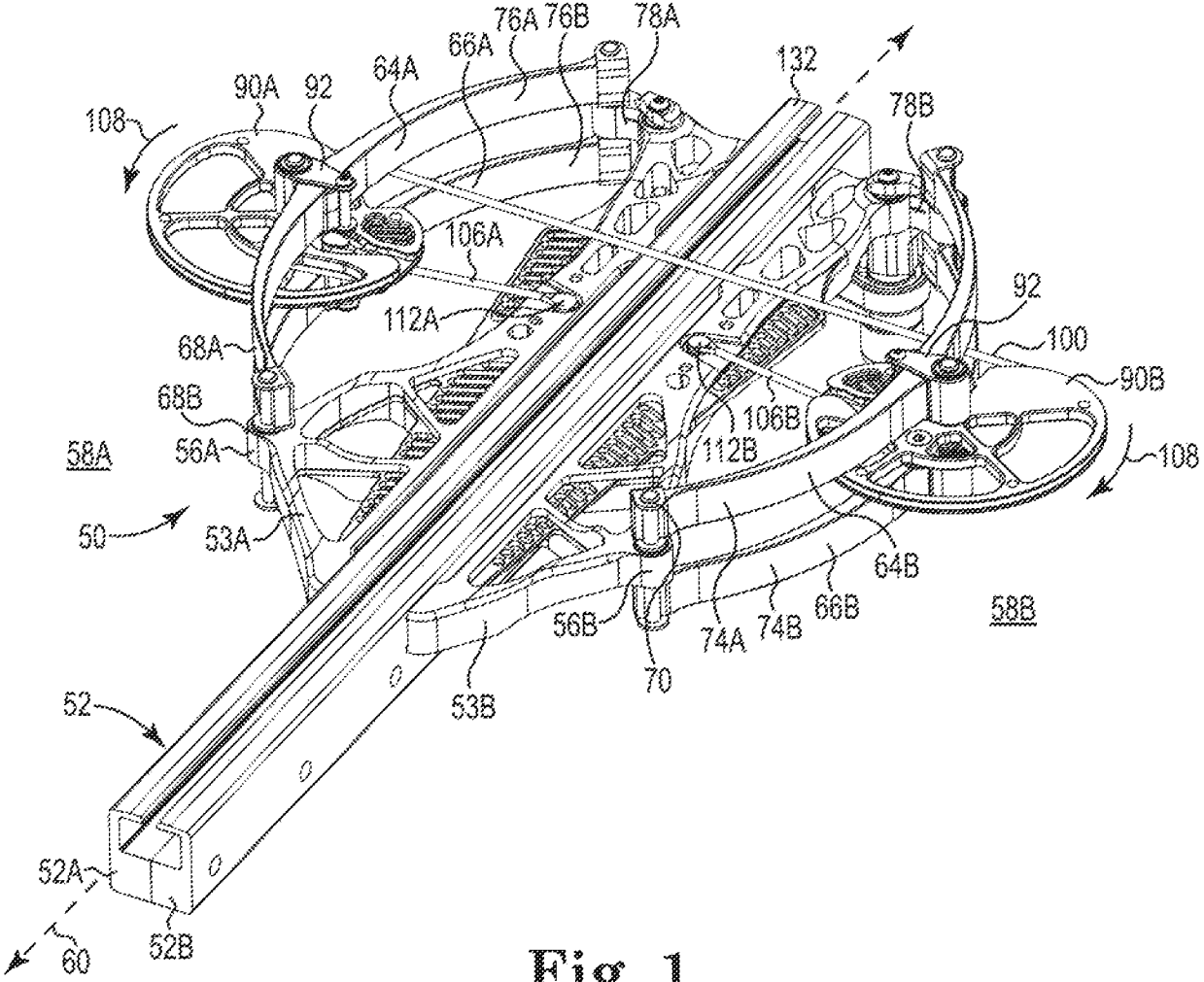
FIG. 1 is a perspective view of an energy storage system in accordance with an embodiment of the present disclosure.
Figure 2:
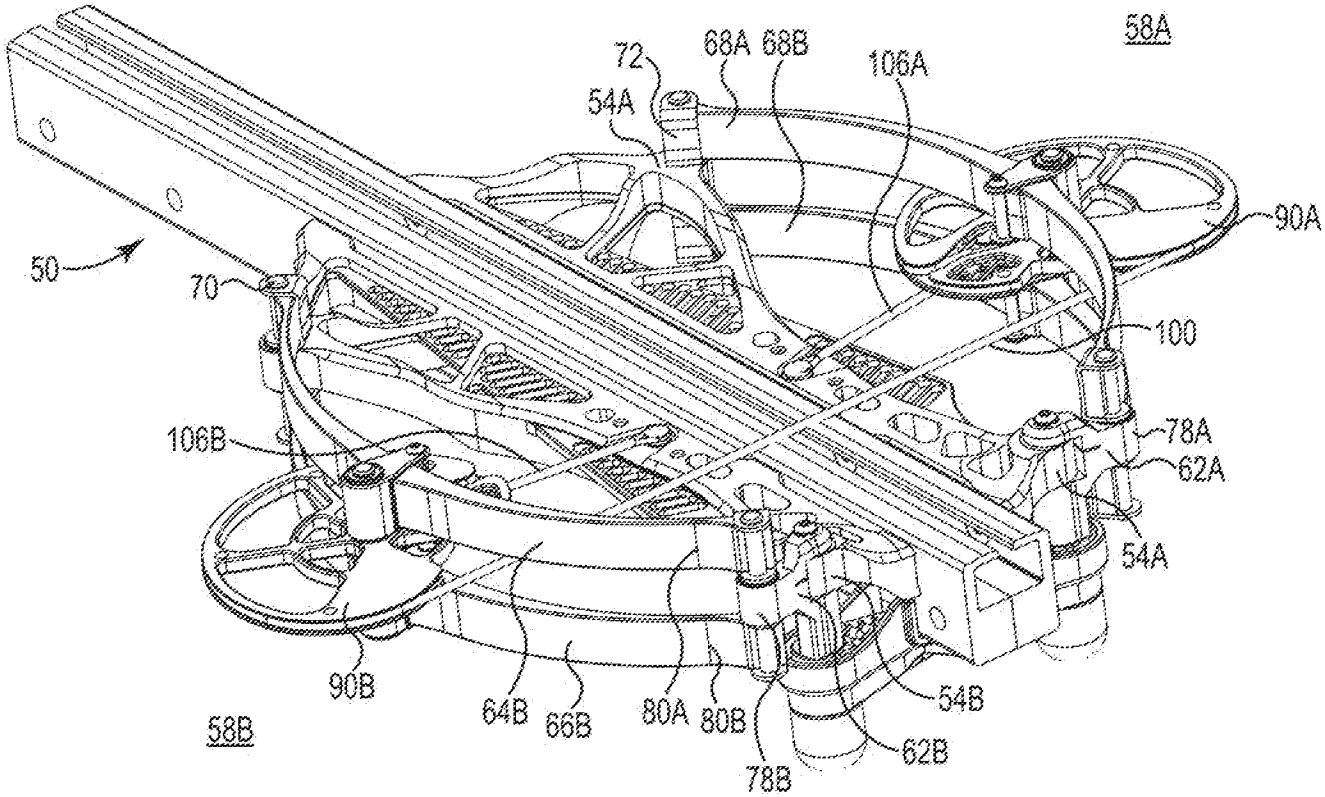
FIG. 2 is an alternate perspective view of the energy storage system of FIG. 1.

For example, in the embodiment of FIG. 1, both ends of the limbs 64, 66 are positively coupled to the center support 52. The proximal ends 68, 74 use a rotating or pivoting coupling and the distal portions 76, 80 use a linkage coupling.

Figure 8:
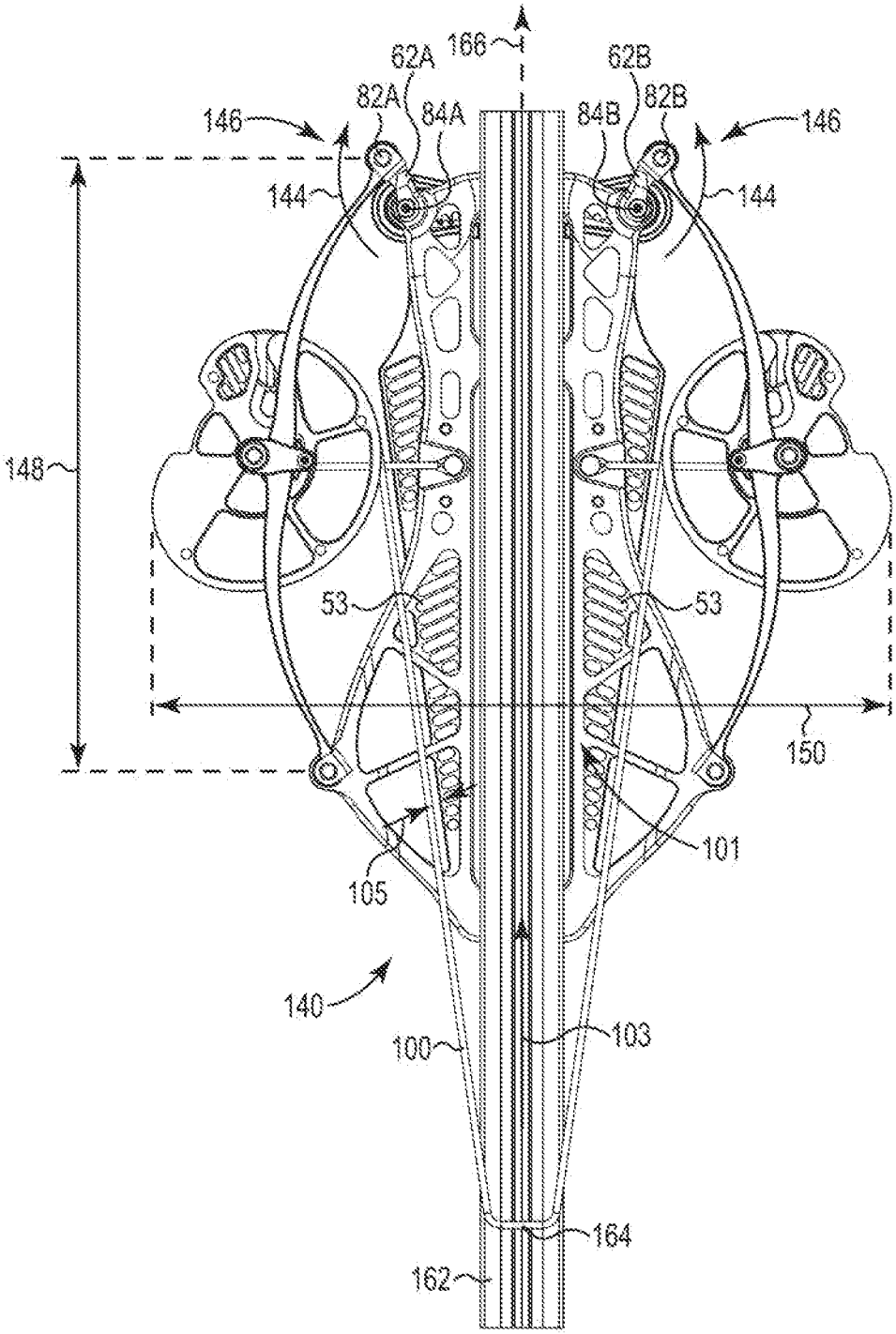
FIG. 8 is a top view of the energy storage system of FIG. 1 in a drawn configuration in accordance with the embodiment of the present disclosure.

As illustrated in FIG. 8, the inward deformation of the limbs 64, 66 forces the translation arms 62 to rotate in distal directions 144 around pivot axes 84 to extended position 146. The translation arms 62 provide limb relief between the distal portions 74 and the proximal portion 68 of the limbs 64, 66. As used herein, "limb relief" means displacement between a proximal portion of a limb relative to a distal portion of the limb when a certain level of tension is applied to a draw string. The displacement can be translation, rotation, flexure, or a combination thereof, occurring at either or both ends of the limbs. The limb relief is typically provided by the couplings and/or the center support 52.

Various structures for providing limb relief are discussed herein. For example, limb relief can be provided by locating pivot arms 62 between proximal portions 68, 74 of the limbs 64, 66 and the proximal limb mounts 54. In yet another embodiment, limb relief is provided by pivot arms 62 located at both the distal portions 76, 80 and the proximal portions 68, 74 of the limbs 64, 66.

In an alternate embodiment, the translation arms 62 are replaced with elastomeric members that are rigidly attached to the finger guard 53. Limb relief is achieved by elastic deformation of the elastomeric translation arms. In another embodiment, limb relief is provided by a combination of deformation and rotation of the elastomeric translation arms 62 (see e.g., FIG. 16).

In yet another embodiment, one or both of the distal and proximal limb mounts 54, 56 are configured as slots with an elastomeric bushing to provide the limb relief.

Figure 19B:
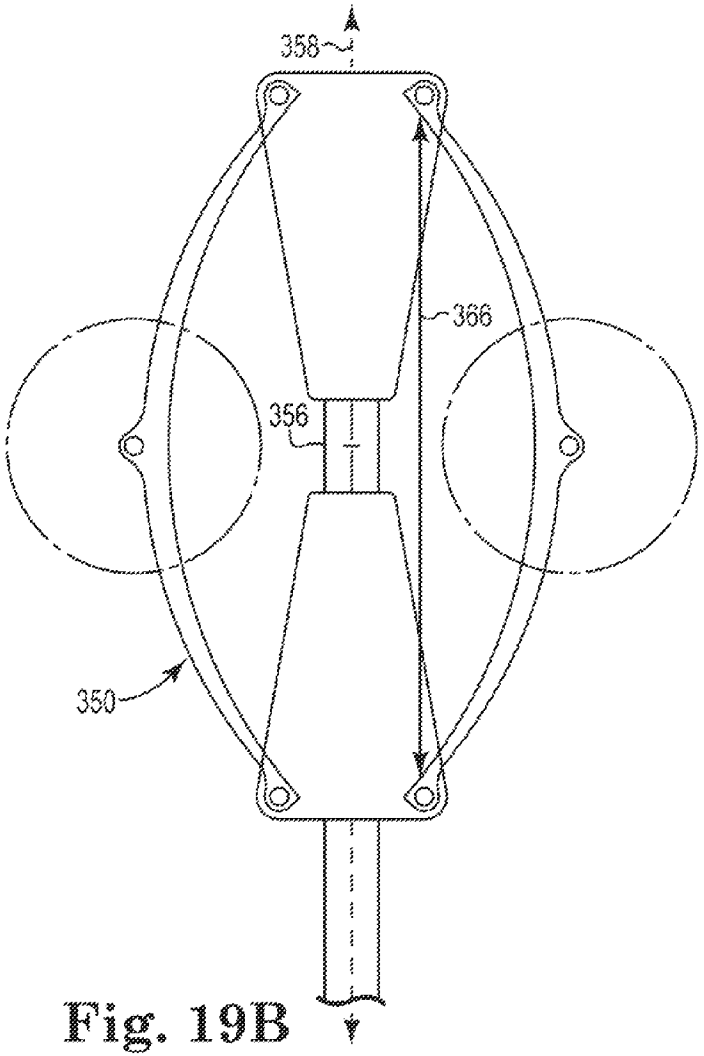
FIGS. 19A and 19B an energy storage portion for a bow with a center support that provides limb relief in accordance with an embodiment of the present disclosure.
Figure 19A:
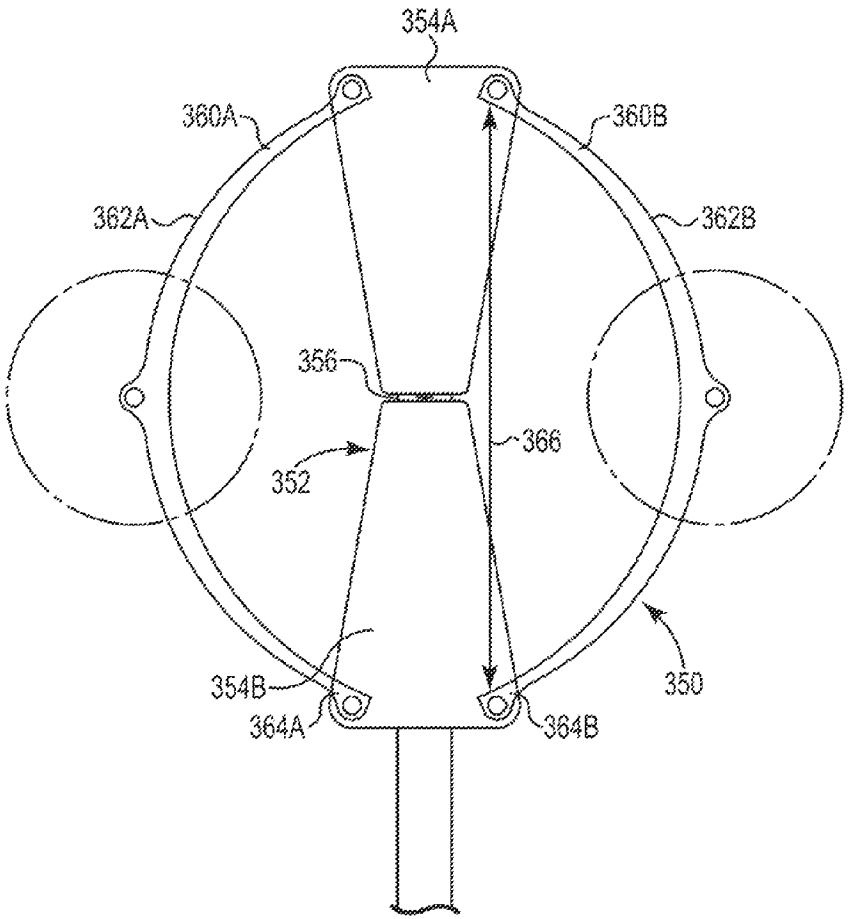

In yet another embodiment, limb relief is provided by the center support 52 (see e.g., FIGS. 19A and 19B).

First pulley assembly 90A is pivotally coupled to the first limbs 64A, 66A at a location between the proximal and distal portions 68, 76. Second pulley assembly 90B is pivotally coupled to the second limbs 64B, 66B at a location between the proximal and the distal portions 74, 80. As best illustrated in FIG. 3, the first and second pulley assemblies 90A, 90B rotate around axes 94A, 94B. In the illustrated embodiment, the first pulley assembly 90A is located between the limbs 64A, 66A and the second pulley assembly 90B is located between the limbs 64B, 66B.

As used herein, the term "pulley" is refers generically to a member rotating around an axis that is designed to support movement of a flexible member, such as a rope, string, belt, chain, and the like. Pulleys typically have a groove, channel or journal located between two flanges around at least a portion of its circumference that guides the flexible member. Pulleys can be round, such as a drum or a sheave, or non-round, such as a cam. The axis of rotation can be located concentrically or eccentrically relative to the pulley.

As best illustrated in FIG. 3, the pulleys 90A, 90B include draw string journals 96A, 96B ("96") configured to receive draw string 100. The draw string journals 96 are located in plane 98 that is located above top surface 102 of the center support 52. As will be discussed below, the draw string journals 96 are arranged so that the string 100 travels close to the top surface 102 of the center support 52 between a release configuration 130 and a drawn configuration 140 (See FIGS. 7 and 8). The pulleys 90 also include power string journals 104A, 104B ("104") configured to receive power strings 106A, 106B that are located below and generally parallel to the draw string journals 96. As used herein, "string" refers generically to any flexible member, such as woven and non-woven filaments of synthetic or natural materials, cables, belts, chains, and the like.

Figure 5:
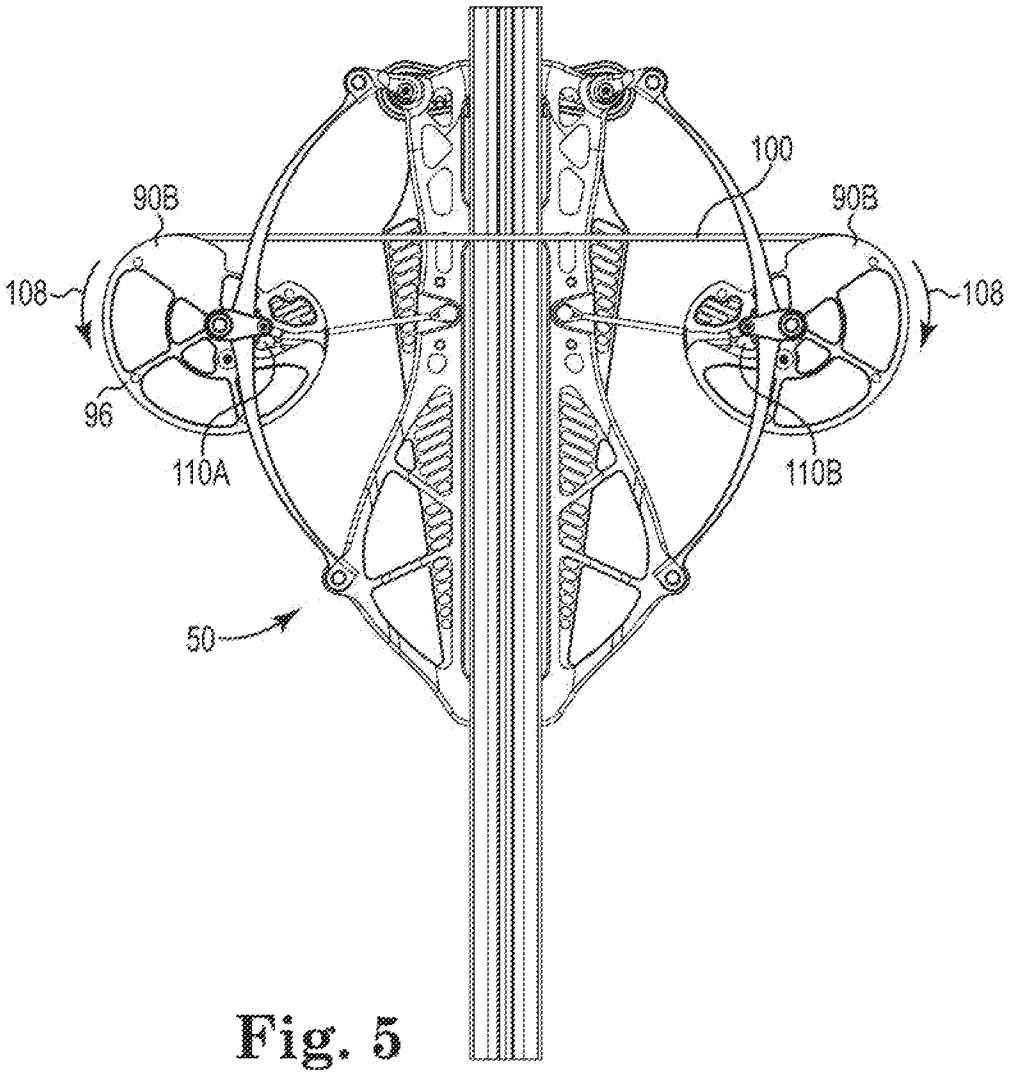
FIG. 5 is a sectional view showing the draw string of the energy storage system of FIG. 1 in a released configuration.

FIG. 5 is a sectional view of the energy storage device 50 showing the path of the draw string 100 on the pulley assemblies 90 in the released configuration 130. The draw string 100 wraps around distal portions of the draw string journals 96 in direction 108 and the ends of the draw string 100 are attached to anchors 110A, 110B on the pulleys 90A, 90B, respectively. In the illustrated embodiment, the draw string 100 crosses over the center support 52 only once.

Figure 6:
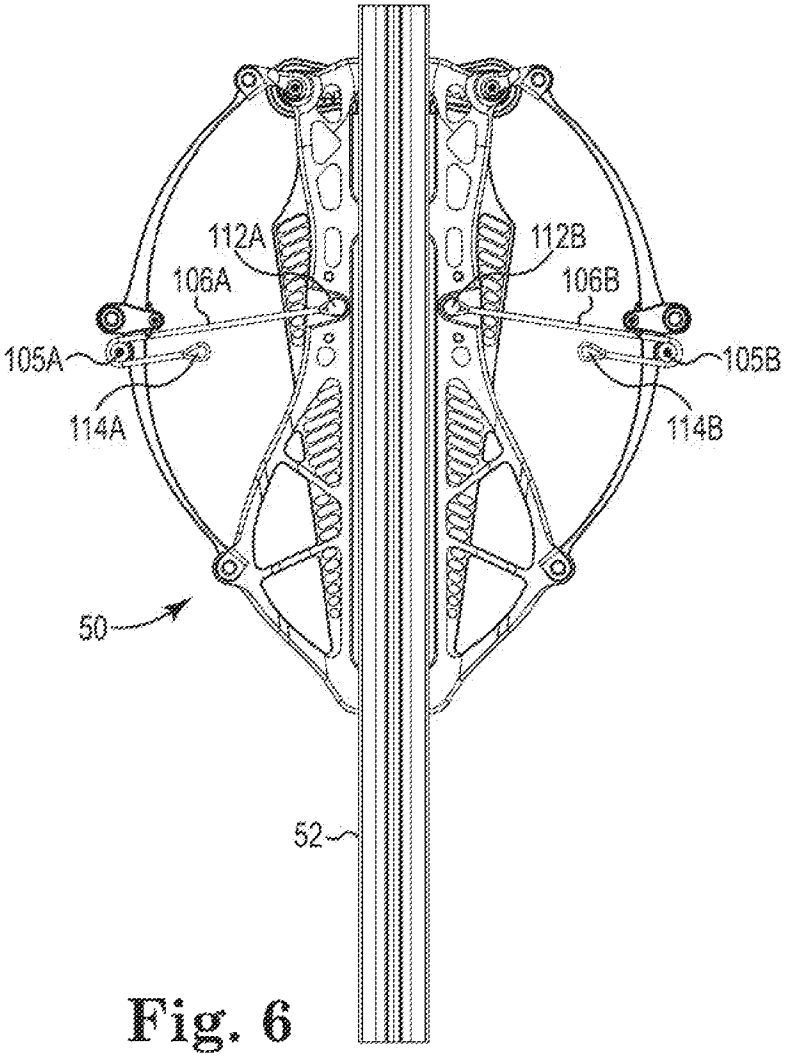
FIG. 6 is a sectional view showing the power strings of the energy storage system of FIG. 1 in the release configuration.

FIG. 6 is a sectional view of the energy storage device 50 showing the path of the power strings 106A, 106B in the release configuration 130. The power strings 106 attach to the center support 52 by anchors 112A, 112B and wrap around distal portions of the power string pulleys 105A, 105B, respectively. The opposite ends of the power strings 106A, 106B are attached to the pulleys 90A, 90B (not shown) by anchors 114A, 114B, respectively. In the illustrated embodiment, the power strings 106 do not cross over the center support 52.

The geometric profiles of the draw string journals 96 and the power string journals 104 contribute to let-off at full draw. The configuration of the limbs 64, 66 and the limb relief of the limbs 64, 66 to the center support 52 also contribute to let-off. A more detailed discussion of cams suitable for use in bows is provided in U.S. Pat. No. 7,305,979 (Yehle), which is hereby incorporated by reference.

Figure 7:
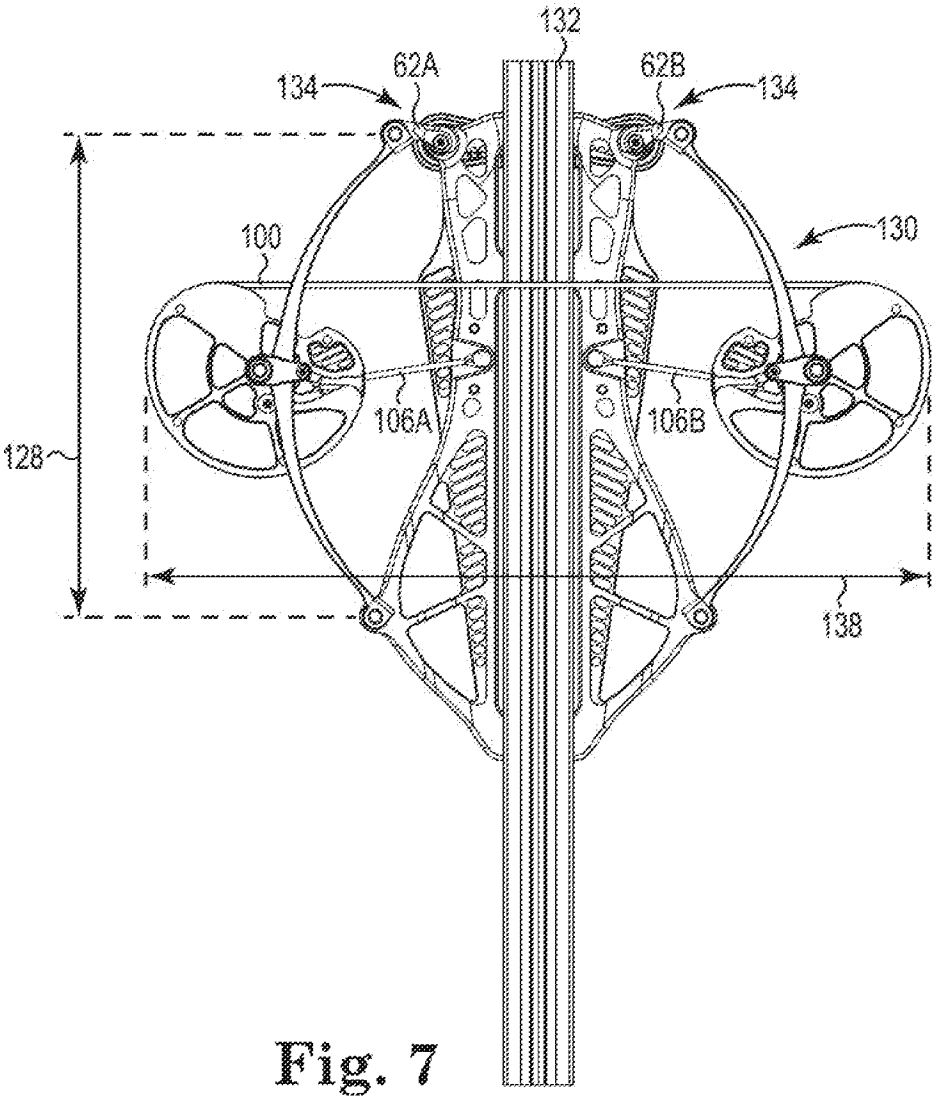
FIG. 7 is a top view of the energy storage system of FIG. 1 in a released configuration in accordance with the embodiment of the present disclosure.

FIG. 7 is a top view of the energy storage device 50 in a released configuration 130 with the draw string 100 in its forward most position relative to the distal end 132 of the center support 52. Static tension between the draw string 100 and the power strings 106 is opposed by slight flexure of the limbs 64, 66 to maintain the translation arms 62 in retracted position 134.

In the retracted position 134 the translation arms 62 are rotated back toward proximal end 136 of the center support, with the limbs 64, 66 in a generally concave configuration with respect to the center support 52. In the release configuration 130 distance 128 between the proximal limb mounts 56 and the translation arm mounts 78 is at a minimum and width 138 of the energy storage device 50 is at its maximum.

FIG. 8 is a top view of the energy storage device 50 with the draw string 100 in a drawn configuration 140. The process of drawing the draw string 100 toward the proximal end 136 of the center support 52 simultaneously causes the pulley assemblies 90 to rotate in directions 142 and the limbs 64, 66 to deform inward toward the center support 52.

In the illustrated embodiment, the limb relief increases the distance 148 between the proximal limb mounts 56 and the translation arm mounts 78 to be greater than the distance 128 (see FIG. 5). In the drawn configuration 140 distance 148 between the proximal limb mounts 56 and the translation arm mounts 78 is at a maximum and width 150 of the energy storage device 50 is at a minimum. The distance 148 in the drawn configuration 140 is greater than the distance 128 in the released configuration 130. The width 150 in the drawn configuration is less than the width 138 in the released configuration 130.

Operation of the illustrated embodiment includes locating an arrow or bolt in groove 162 with knock engaged with the draw string 100 in location 164. Release of the draw string 100 causes the limbs 64, 66 to return to the released configuration 130, thereby launching the bolt in direction 166.

As best illustrated in FIG. 8, the finger guards 53 is configured to extend to at least space 101, which corresponds to the space traversed by the draw string 100 from the drawn configuration 140 to the released configuration 130. The finger guard 53 is configured to reduce the chance of a user's finger extending up from the bottom of the center support 52 and into the path 103 of the drawing string 100 from the drawn configuration 140 to the released configuration 130. In the preferred embodiment, the finger guard 53 completely blocks access from the bottom of the center support 52 to the space 101. In another embodiment, gap 105 between the draw string 100 and the finger guards 53 is less than about 0.5 cm.

The energy storage device 50 typically includes a trigger assembly to retain the draw string 100 in the drawn configuration 140 and a stock located near the proximal end 136 of the center support 52. Most trigger assemblies include a dry fire mechanism that prevents release of the draw string 100 unless a bolt is positioned in the center support 52. Suitable trigger assemblies and stocks are disclosed in U.S. Pat. No. 8,240,299 (Kronengold et al.); U.S. Pat. No. 8,104,461 (Kempf); U.S. Pat. No. 8,033,275 (Bendar et al.); U.S. Pat. No. 8,020,543 (Maleski et al.); U.S. Pat. No. 7,836,871 (Kempf); U.S. Pat. No. 7,810,480 (Shepley et al.); U.S. Pat. No. 7,770,567 (Yehle); U.S. Pat. No. 7,743,760 (Woodland); U.S. Pat. No. 7,363,921 (Kempf); U.S. Pat. No. 7,328,693 (Kempf); U.S. Pat. No. 7,174,884 (Kempf et al.); U.S. Pat. No. 6,736,123 (Summers et al.); U.S. Pat. No. 6,425,386 (Adkins); U.S. Pat. No. 6,205,990 (Adkins); U.S. Pat. No.

5,884,614 (Darlington et al.); U.S. Pat. No. 5,649,520 (Bednar); U.S. Pat. No. 5,598,829 (Bednar); U.S. Pat. No. 5,596,976 (Waiser); U.S. Pat. No. 5,085,200 (Horton et al.); U.S. Pat. No. 4,877,008 (Troubridge); U.S. Pat. No. 4,693,228 (Simonds et al.); U.S. Pat. No. 4,479,480 (Holt); U.S. Pat. No. 4,192,281 (King); and U.S. Pat. No. 4,030,473 (Puryear), which are hereby incorporated by reference.

Figure 9:
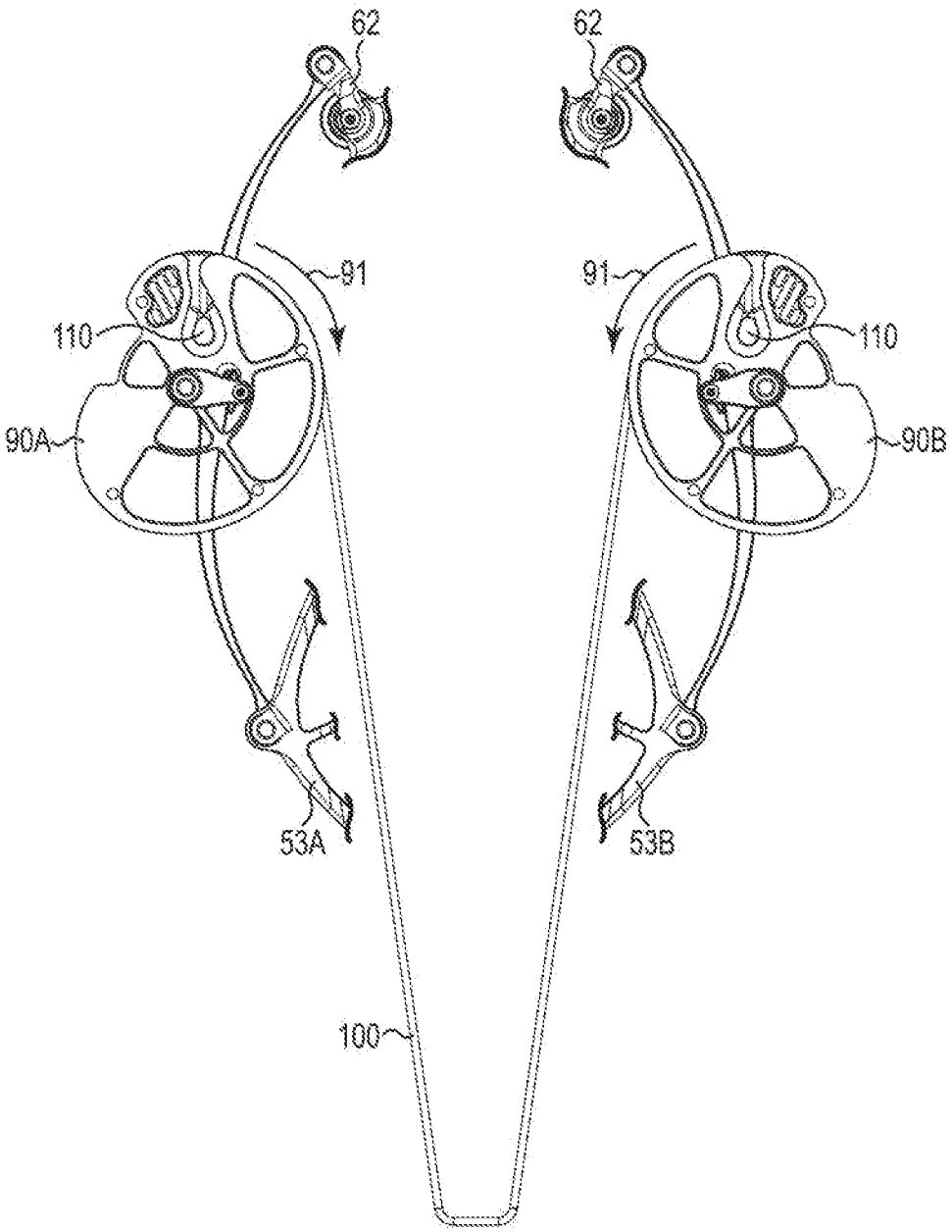
FIG. 9 is a sectional view showing the draw string of the energy storage system of FIG. 1 in a drawn configuration.

FIG. 9 is a sectional view of FIG. 8 with the center support 52 removed to better illustrate the path of the draw string 100 in the drawn configuration 140. The pulley assemblies 90 are rotated in direction 91 until the draw string is fully drawn.

Figure 10:
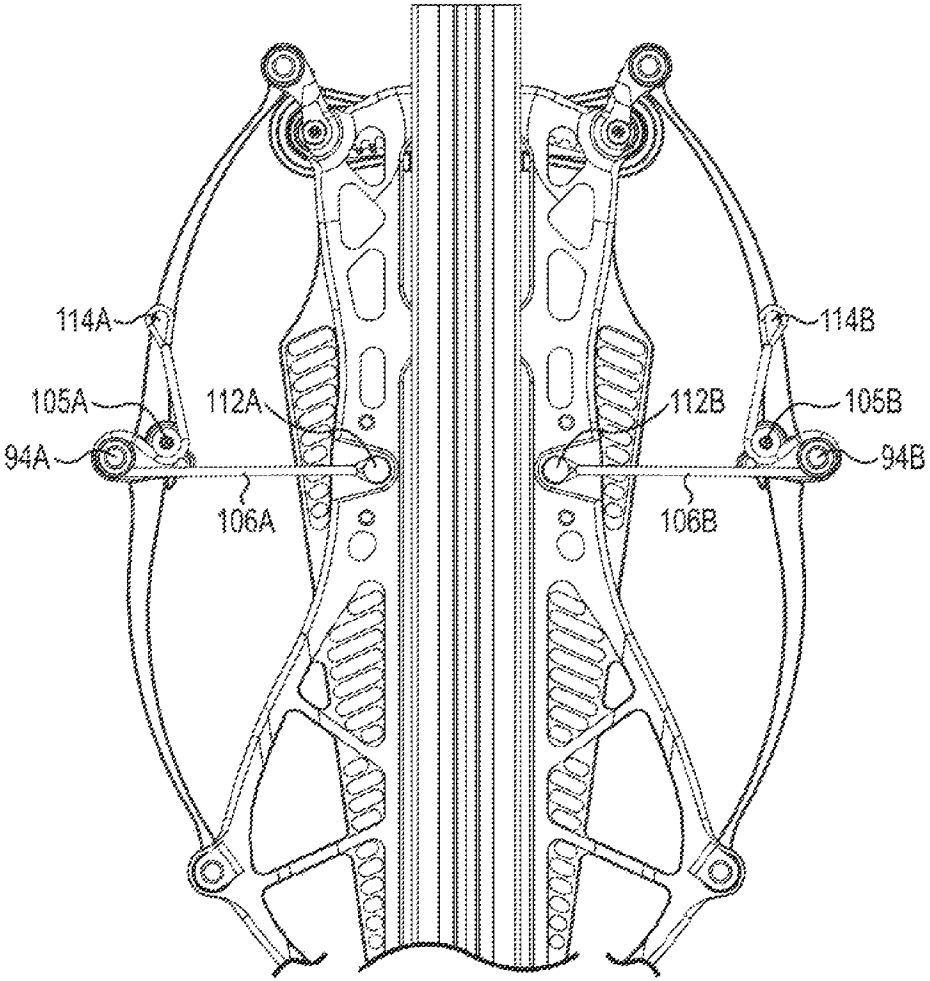
FIG. 10 is a sectional view showing the power strings of the energy storage system of FIG. 1 in the drawn configuration.

FIG. 10 is a sectional view of FIG. 8 with the draw string pulleys removed to illustrate the path of the power strings 106 in the drawn configuration 140. The power strings 106 wrap around the power pulleys 105 in a first direction and around the pivot axes 94 of the pulley assemblies 90 in the opposite direction, terminating at anchors 112, as discussed above.

Figure 11:
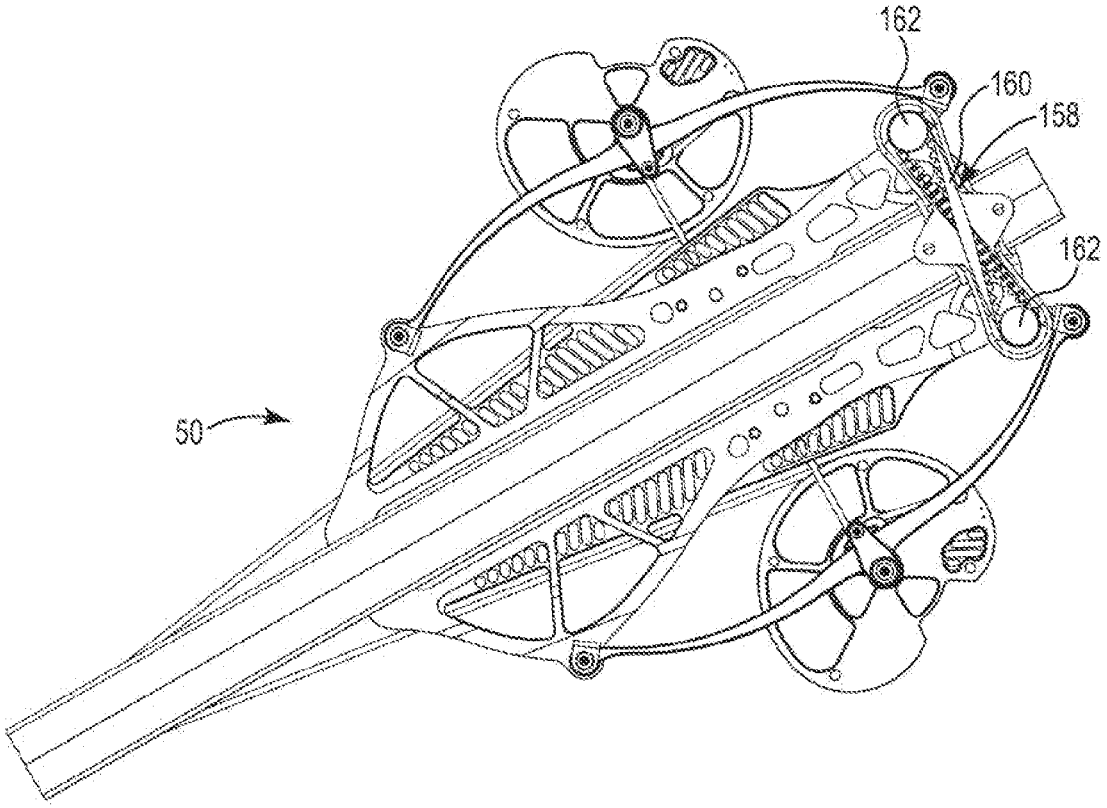
FIG. 11 is a bottom view of the energy storage system of FIG. 1 showing a timing belt in accordance with an embodiment of the present disclosure.

FIG. 11 is a bottom sectional view of the energy storage device 50 with synchronization assembly 158 exposed. In the illustrated embodiment, the synchronization assembly 158 includes timing belt 160 wrapped around pulleys 162 that are coupled to the rotation of the translation arms 62. The timing belt 160 synchronizes the rotation of the translation arms 62 (see FIG. 6A) between the retracted position 134 and the extended position 146. In the illustrated embodiment, the timing belt 160 is a toothed belt twisted into a figure eight configuration. Alternate synchronization assemblies can include gears, belts, cables, chains, linkages, and the like.

Figure 12A:
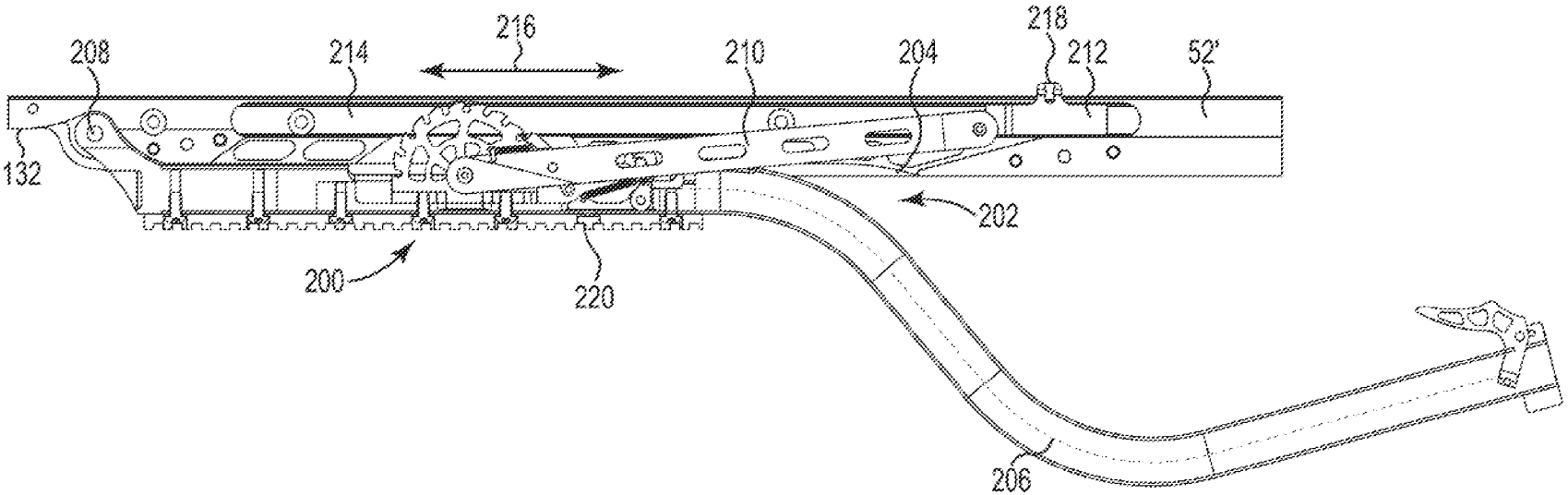
FIG. 12A is a sectional view of a center support with a cocking system in accordance with an embodiment of the present disclosure.
Figure 12B:
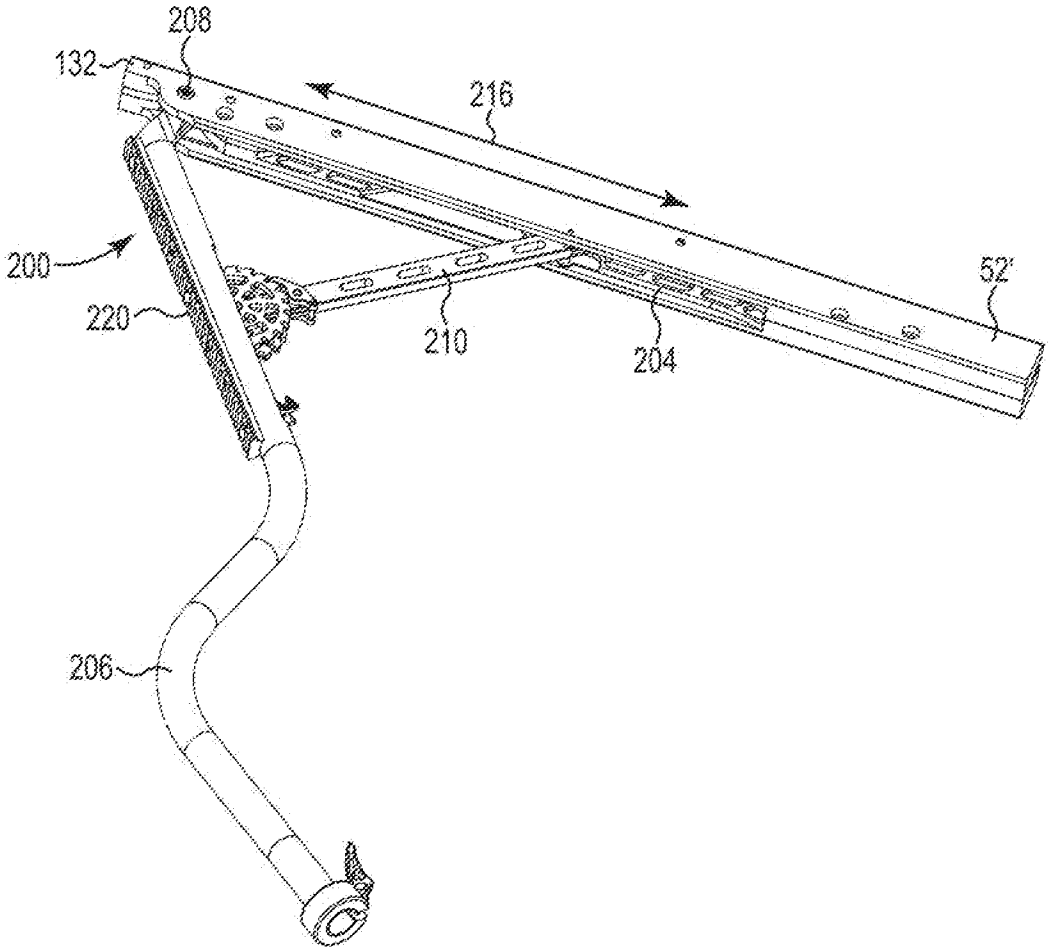
FIG. 12B is perspective view of the center support of FIG. 12A.

FIG. 12A is a sectional view of an alternate center support 52' modified to include cocking mechanism 200 shown in a closed and locked configuration 202 in accordance with an embodiment of the present disclosure. FIG. 12B is a perspective view of the center support 52' with the cocking mechanism 200 in a partially opened configuration.

The center support 52' is machined to create opening 204 that receives the cocking mechanism 200. The cocking mechanism 200 includes an elongated tube 206 pivotally attached to the center support 52' at location 208 near the distal end 132. Arm 210 pivotally couples the elongated tube 206 to traveler 212 that slides back and forth along axis 216 in channel 214 formed in the center support 52'. The traveler 212 includes finger 218 that captures the draw string 100 to move it from the released configuration 130 to the drawn configuration 140 and into engagement with a trigger assembly (not shown). In the illustrated embodiment, the elongated tube 206 includes a conventional accessory rail 220, used to attach various accessories to the center support 52', such as forward grips, laser sights, and the like.

Figure 13:
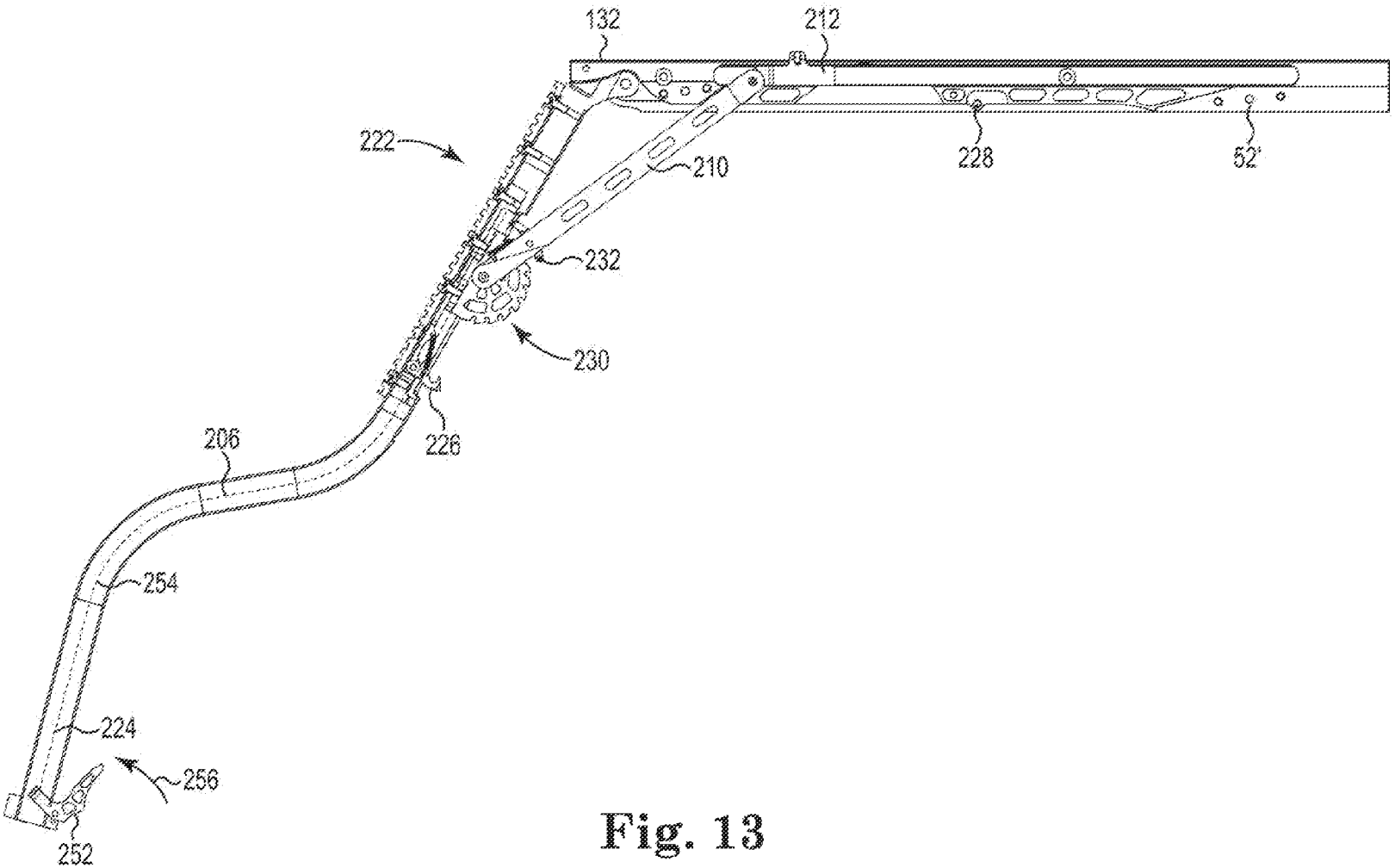
FIG. 13 is a sectional view of the cocking mechanism of FIG. 12A in a fully open configuration in accordance with an embodiment of the present disclosure.

FIG. 13 is a sectional view of the center support 52' in a fully open configuration 222. The arm 210 advances the traveler 212 to the distal end 132 of the center support 52' to capture the draw string 100. In order to cock the energy storage device 50, the user grasps proximal end 224 of the elongated tube 206 and returns it to the closed and locked configuration 202. Latch 226 engaged with pin 228 on the center support 52' to lock the cocking mechanism 200 in the closed and locked configuration 202.

The limbs 64, 66 resist movement of the elongated tube 206 back to the closed and locked configuration 202. If the user inadvertently releases the elongated tube 206 during this process, it will snap back to the fully open configuration 222 with considerable force. Ratcheting mechanism 230 prevents this outcome.

Figure 14:
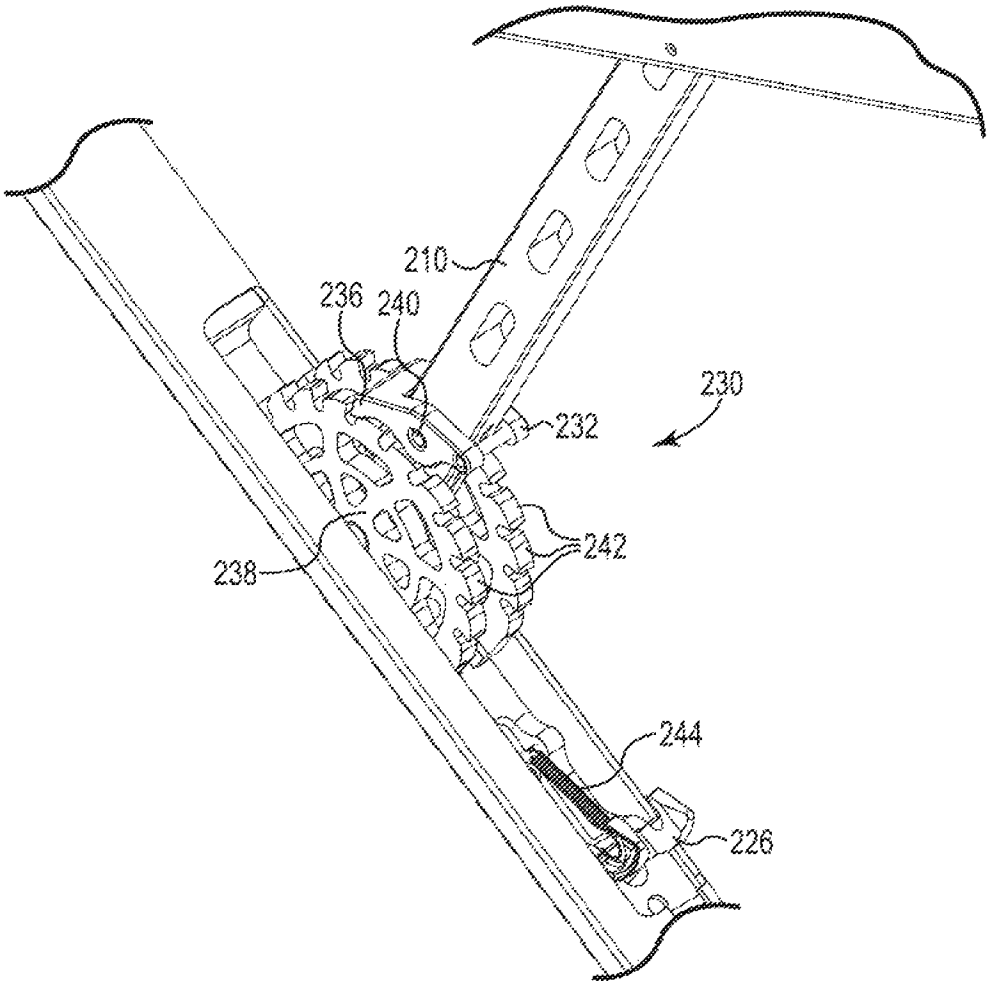
FIG. 14 is a perspective view of a ratcheting mechanism for a cocking mechanism in accordance with an embodiment of the present disclosure.
Figure 15:
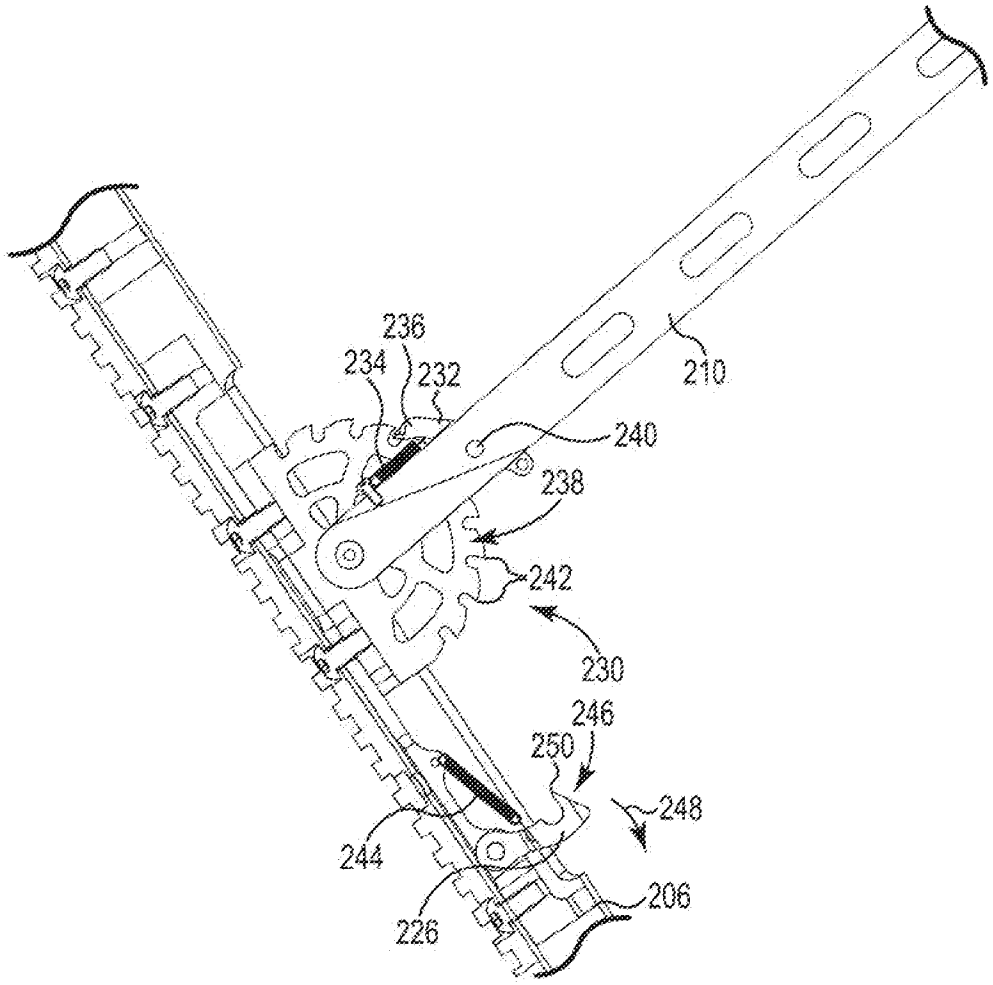
FIG. 15 is a sectional view of the ratcheting mechanism of FIG. 14.

As best illustrated in FIGS. 14 and 15, the ratcheting mechanism 230 includes pawl 232 pivotally attached to the arm 210. Spring 234 biases distal end 236 of the pawl 232 into engagement with tooth members 238 that are mounted to the elongated tube 206. As the elongated tube 206 is moved to the closed and located configuration 202, the pawl 232 rocks up and down around pivot 240 to sequentially engage with teeth 242. As a result, inadvertent release of the elongated tube 206 does not result in the cocking mechanism 200 returning to the fully open configuration 222.

Also illustrated in FIGS. 14 and 15 is additional detail for the latch 226. Spring 244 biases the latch 226 in a locked configuration 246. As the elongated tube 206 is pushed to the closed and locked configuration 222, the latch 226 is pushed by the pin 228 in direction 248 until the pin 228 clears tip 250, at which point the latch 226 returns to the locked configuration 246.

As illustrated in FIG. 13, operation of the pawl 232 and the latch 226 is simultaneously controlled by thumb trigger 252 located near proximal end 224 of the elongated tube 206. In the illustrated embodiment, cable 254 is attached to the thumb trigger 252 and both of the pawl 232 and the latch 226. Depressing the thumb trigger 252 in direction 256 disengages the pawl 232 from the teeth 242 and the latch 226 from the pin 228, respectively. Various alternate cocking mechanisms can be used to pull the draw string 100 to the drawing configuration 130, such as disclosed in U.S. Pat. No. 7,624,725 (Choma); U.S. Pat. No. 7,204,242 (Dziekan); U.S. Pat. No. 6,913,007 (Bednar); U.S. Pat. No. 4,942,861 (Bozek); U.S. Pat. No. 6,799,566 (Malucelli); U.S. Pat. No. 6,705,304 (Pauluhn); U.S. Pat. No. 6,286,496 (Bednar); U.S. Pat. No. 6,095,128 (Bednar); and U.S. Pat. No. 4,719,897 (Gaudreau), which are hereby incorporated by reference.

Figure 16:
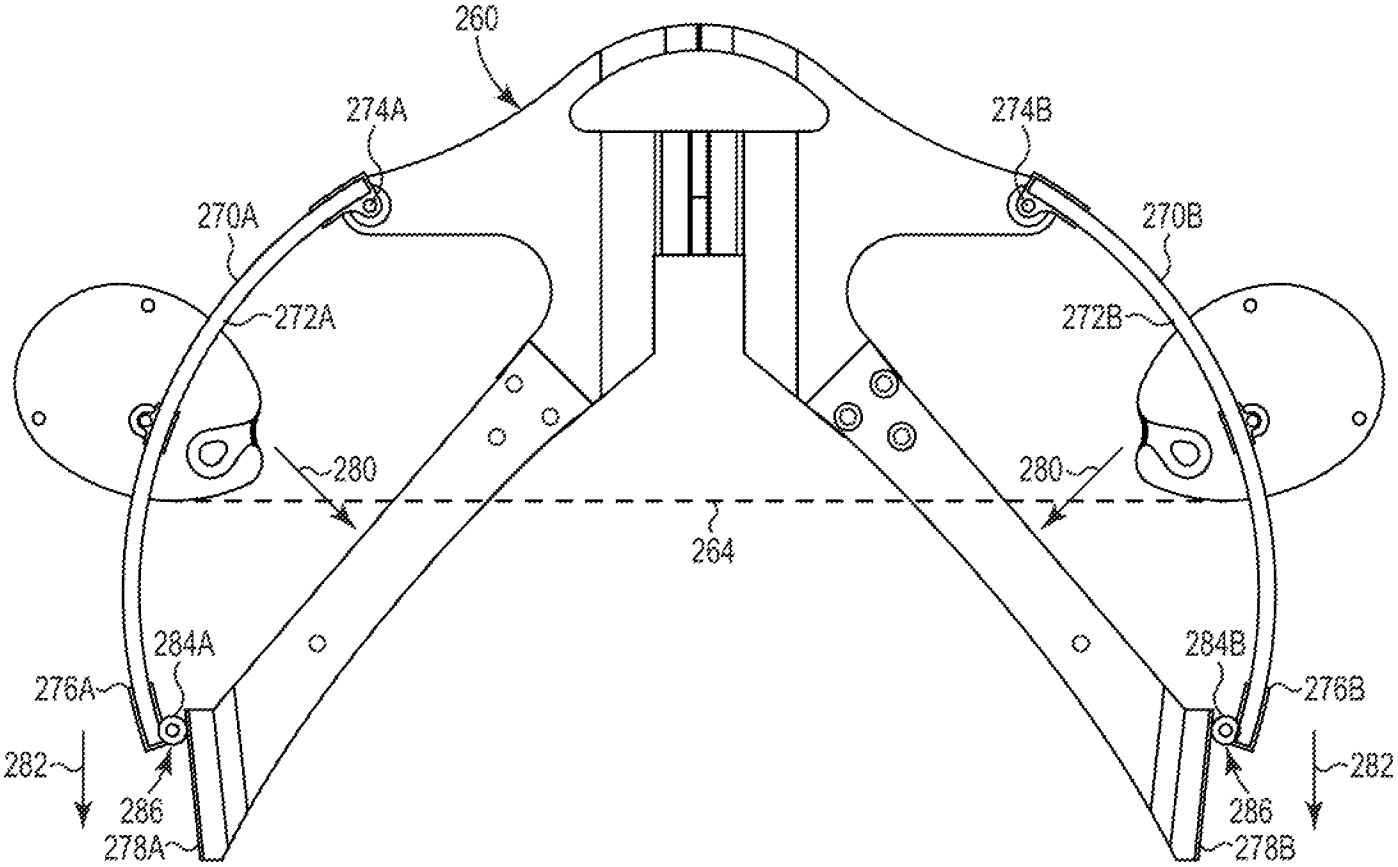
FIG. 16 is a plan view of an alternate energy storage device for an energy storage system in accordance with an embodiment of the present disclosure.

FIG. 16 illustrates an alternate energy storage device 260 with alternate limb relief in accordance with an embodiment of the present disclosure. The center support 262, the draw string 264, and the power stings 266A, 266B are removed for clarity (see FIG. 17).

Distal portions 270A, 270B ("270") of limbs 272A, 272B ("272") are attached to the device 260 at locations 274A, 274B (274"), respectively. The attachment at the locations 274 can employ various couplings (e.g., a rigid coupling, a pivoting coupling, a linkage coupling, a rotating coupling, a sliding coupling, an elastomeric coupling, or a combination thereof). Proximal portions 276A, 276B ("276") of the limbs 272 are configured to engage with portions 278A, 278B ("278") of the device 260, respectively. It is possible to reverse this configuration by locating the portions 278 at the distal end of the device 260.

When the draw string 264 is in the drawn configuration 140, the limbs 272 deform in direction 280 and the proximal portions 276 translate along portions 278 in direction 282 to provide limb relief through a sliding coupling. In one embodiment, the portions 278 have a curvilinear shape to increase let-off when the draw string 264 is in the fully drawn configuration 140.

In another embodiment, the proximal portions 276 are dynamically coupled to the portions 278 of the device 260. The proximal portions 278 are not attached to the device 260. For example, space 286 may exist between the proximal portions 276 of the limbs 272 and the portions 278 when the draw string 264 is in the released configuration 130. As the limbs 272 deformed while the draw string 264 is drawn, however, the proximal portions 276 of the limbs 272 engage with the portions 278 on the device 260 and are displaced in the direction 282, in a combination of a dynamic coupling and a sliding coupling.

In another embodiment, the proximal portions 276 are positively coupled to the portions 278 by sliding couplings 284A, 284B ("284"). One advantage of the positive couplings 284 is that when the draw string 264 is released, the proximal portions 276 are prevented from lifting off of the portions 278 on the device 260, reducing noise.

In another embodiment, the proximal portions 276 of the limbs 272 are fixedly attached to the portions 278 of the device 260 as shown. The portions 278 are constructed from an elastomeric material configured to deform as the limbs 272 are deformed in the direction 280 to provide limb relief via an elastomeric coupling.

Any of the limb relief embodiments disclosed herein may be used alone or in combination.

Figure 17:
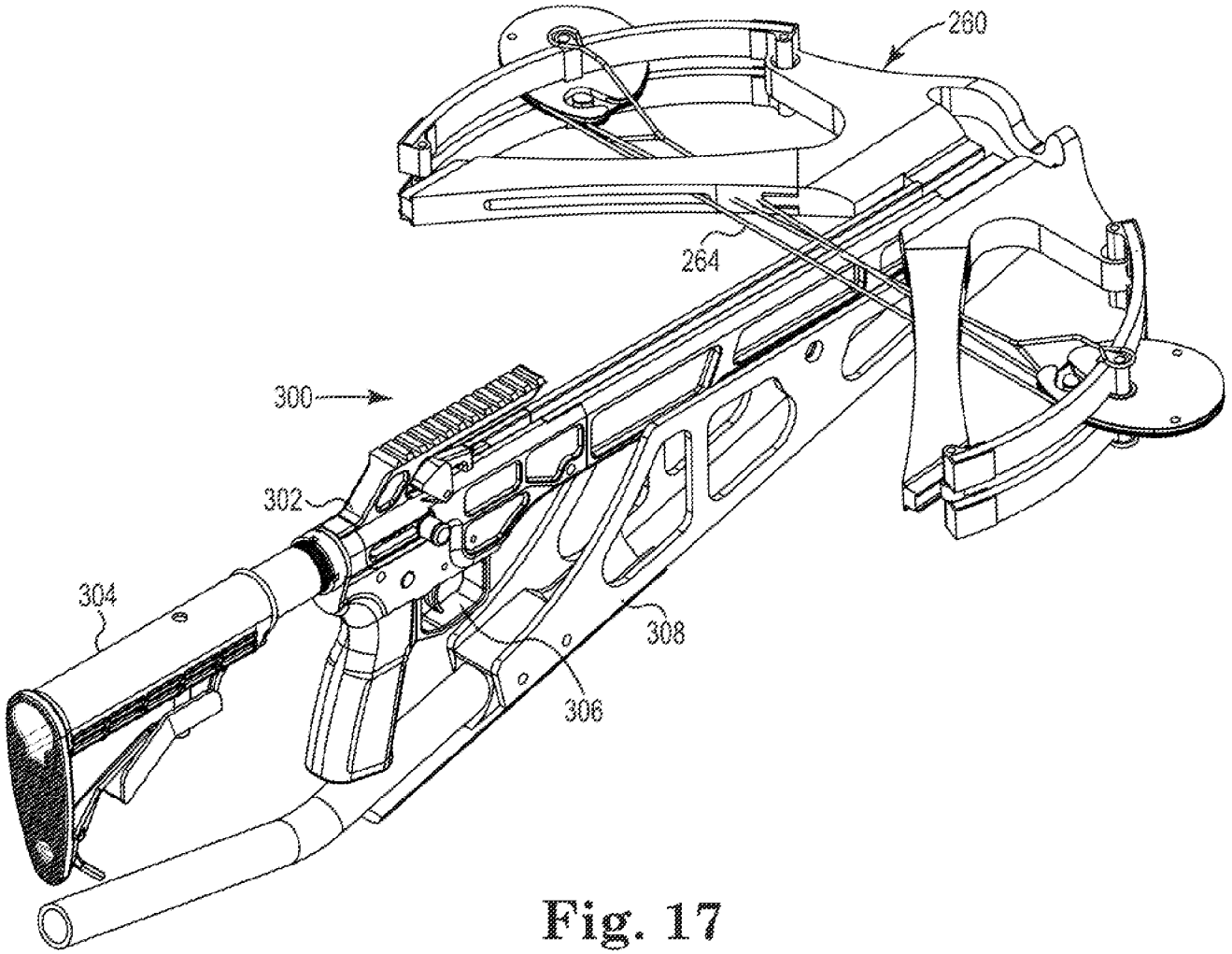
FIG. 17 is a bow with the energy storage device of FIG. 16 in accordance with an embodiment of the present disclosure.

FIG. 17 is a perspective view of bow 300 with the energy storage device 260 in accordance with an embodiment of the present disclosure. Proximal end 302 of the center support 262 includes stock 304 and trigger assembly 306 configured to releasably retain draw string 264 in the drawing configuration 140. Cocking assembly 308 is mounted at bottom of center support 262 as discussed herein.

Figure 18:
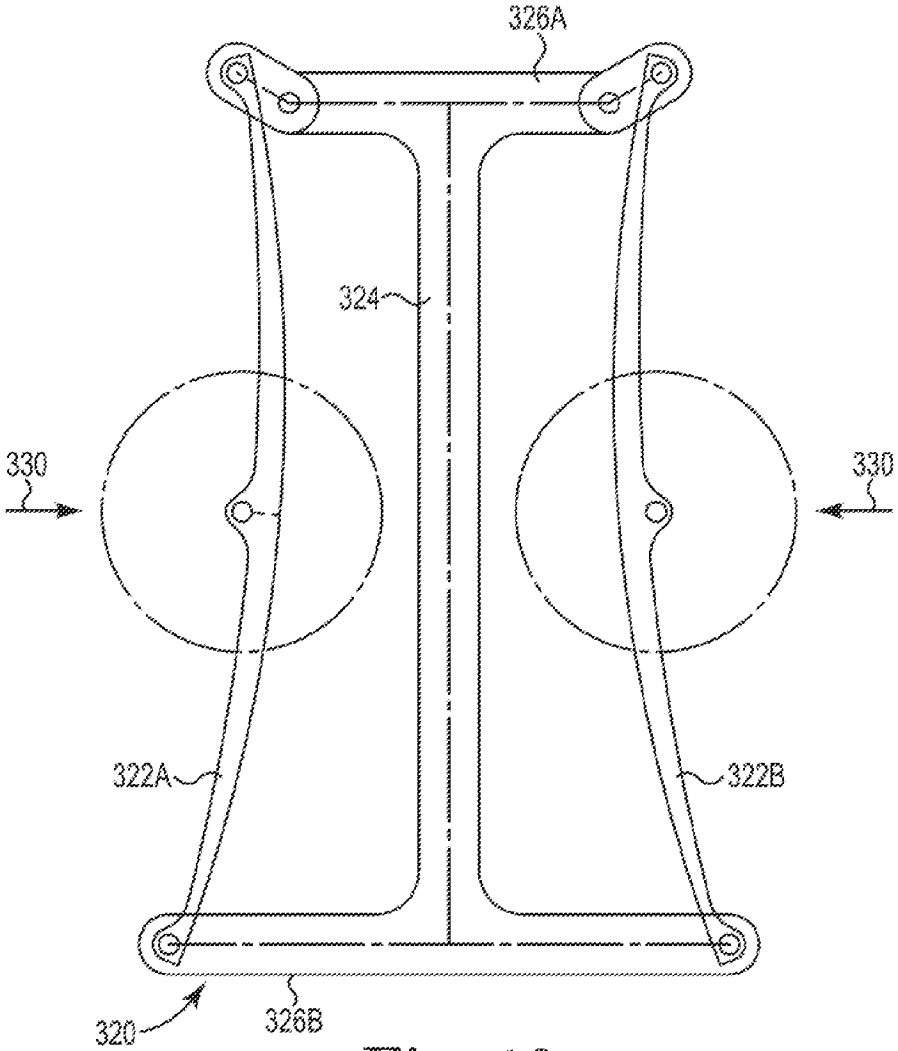
FIG. 18 illustrates an energy storage portion for a bow with convex limbs in accordance with an embodiment of the present disclosure.

FIG. 18 is a schematic illustration of an alternate energy storage device 320 with convex limbs 322A, 322B ("322") with respect to center support 324 in accordance with an embodiment of the present disclosure. The center support 324 includes distal and proximal spacers 326A, 326B ("326") that retain the limbs 322 in a spaced configuration.

The convex limbs 322 deflect inward in directions 330 toward the center support 324 as the draw string (not shown) is moved to the drawing configuration. In the illustrated embodiment, limb relief is provided by translation arms 328, although any of the limb relief mechanism disclosed herein may be used.

FIGS. 19A and 19B illustrate an alternate energy storage device 350 in which limb relief is provided by center support 352 in accordance with an embodiment of the present disclosure. Center support 352 includes a distal portion 354A and a proximal portion 354B connected by displacement mechanism 356. The displacement mechanism 356 permits the distal portion 354 to be displaced relative to the proximal portion 354B along axis 358. The displacement mechanism 356 may be an elastomeric member, a pneumatic or hydraulic cylinder, or a variety of other structures configured to bias the distal portion 354A toward the proximal portion 354B along the axis 358.

Distal ends 360A, 360B ("360") of limbs 362A, 362B ("362") are attached to the distal portion 354A of the center support 352. Proximal ends 364A, 364B ("364") of limbs 362 are attached to the proximal portion 354B of the center support 352. As the draw string (not shown) is moved to the drawing configuration 140, the limbs 362 flatten so that distance 366 between distal ends 360 and proximal ends 364 of the limbs 362 increases to provide limb relief. As the draw string is released, the displacement mechanism 356 biases the distal portion 354A toward the proximal portion 354B to the configuration shown in FIG. 19A.

Figure 20A:
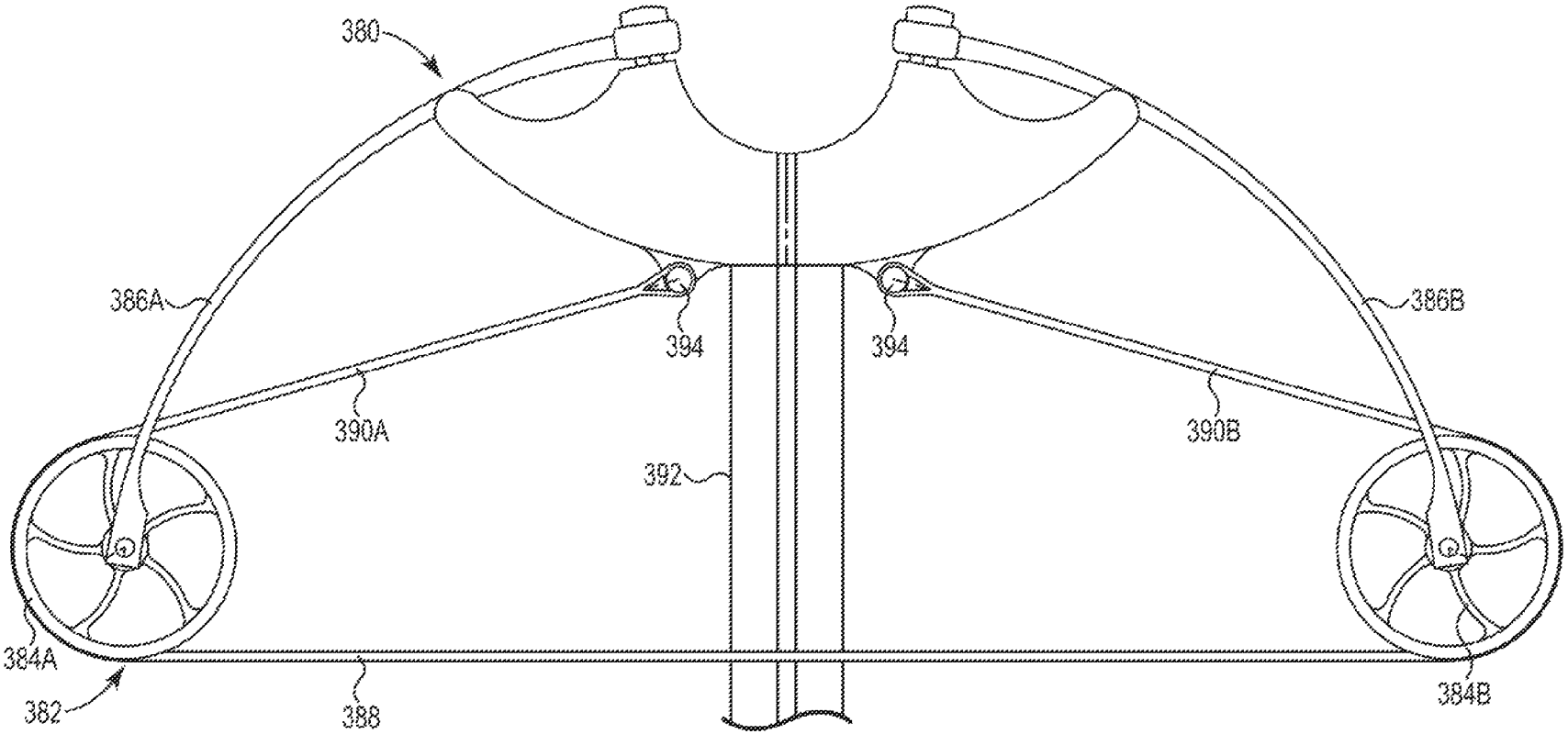
FIGS. 20A and 20B illustrate a conventional energy storage portion of a conventional bow with a pulley system in accordance with an embodiment of the present disclosure.
Figure 20B:
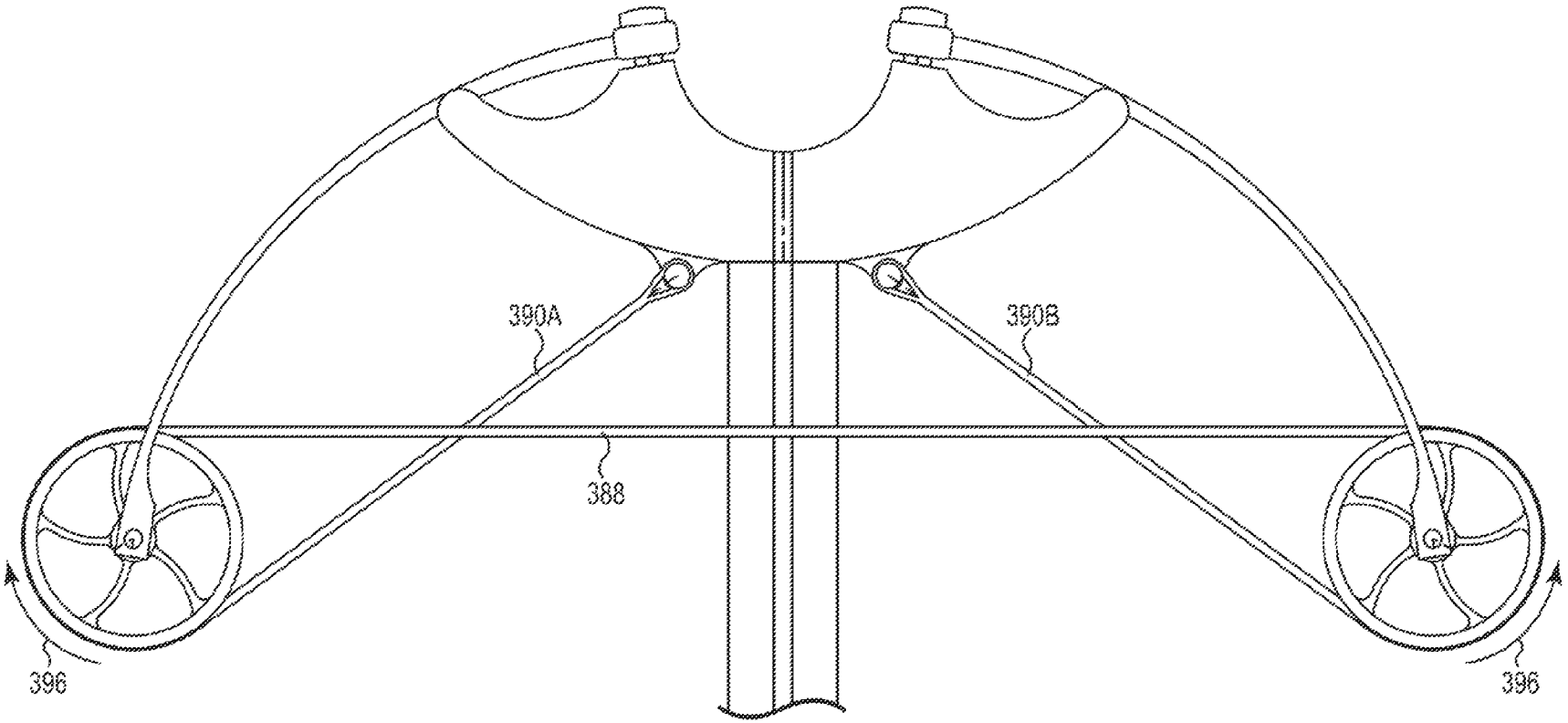

FIGS. 20A and 20B are top views of an energy storage portion 380 of a conventional bow with a pulley system 382 in accordance with an embodiment of the present disclosure. The pulley system 382 includes pulleys 384A, 384B ("384") attached to ends of limbs 386A, 386B ("386"). Drawing string 388 and power strings 390A, 390B ("390") wrap around the pulleys 384 and attach to the center support 392. The power strings 390 do not cross-over the center support 388. Consequently, only the draw string 384 crosses over the center support 388.

In the illustrated embodiment, the power strings 390 and the draw string 388 are a single structure with ends 394 attached to the center support 392. In an alternate embodiment, the power strings 390 and the draw strings 388 can be discrete structures, such as illustrated in FIG. 3. The embodiment of FIG. 20B reverses the wrap of the power strings 390 and draw string 388 around the pulleys 384 in directions 396 to increase the draw length.

Where a range of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed is:

1. An energy storage portion for a bow comprising:

a center support having a first side and a second side;

at least one first limb having a distal portion pivotally coupled to the first side of the center support at a distal limb mount and a proximal portion, pivotally coupled to the first side of the center support at a proximal limb mount;

at least one second limb having a distal portion pivotally coupled to the second side of the center support at a distal limb mount and a proximal portion pivotally coupled to the second side of the center support at a proximal limb mount;

at least one first pulley including a first string journal and a first power cable journal pulley pivotally attached to the first limb at a fixed position located between the distal portion and the proximal portions;

at least one second pulley including a second string journal and a second power cable journal pivotally attached to the second limb at a fixed position located between the distal portion and the proximal portions;

a draw string extending across the center support and engaged with the first and second string journals, the draw string including a first end secured to the first pulley and, a second end secured to the second pulley;

a first power cable engaged with the first power cable journal having a first end attached to the center support and a second end attached to the first pulley;

a second power cable engaged with the second power cable journal having a first end attached to the center support and a second end attached to the second pulley; and couplings interposed between at least one of the distal portions or the proximal portions of the first and second limbs and the respective limb mounts that provides limb relief as the draw string is pulled to a drawn configuration.

2. The energy storage portion for a bow of claim 1 wherein the first and second limbs each comprise a pair of limbs arranged in a spaced apart configuration with the first and second pulleys located between the pair of limbs, respectively.

3. The energy storage portion for a bow of claim 1 wherein the first and second limbs are arranged in a concave or convex configuration with respect to the center support.

4. The energy storage portion for a bow of claim 1 wherein the first and second pulleys comprise cams.

5. The energy storage portion for a bow of claim 1 wherein the first and second pulleys are attached to the first and second limbs, respectively, generally at a midpoint between the distal and proximal portions.

6. The energy storage portion for a bow of claim 1 wherein the first and second power cables do not cross over the center support from the first side to the second side.

7. The energy storage portion of a bow of claim 1 wherein the couplings comprise rotating translation arms pivotally attached to one of the distal portions or the proximal portions of the first and second limbs and the respective limb mounts.

8. The energy storage portion for a bow of claim 7 wherein rotation of the rotating translation arms are synchronized by a synchronization assembly.

9. The energy storage portion for a bow of claim 1 wherein the couplings comprise pivoting couplings, linkage couplings, rotating couplings, sliding couplings, elastomeric couplings, or a combination thereof.

10. The energy storage portion for a bow of claim 1 wherein the center support provides limb relief between the proximal portion and the distal portion of the limbs.

11. The energy storage portion for a bow of claim 1 wherein the first and second pulleys, each rotate around first and second axes, wherein total displacement of the first axis toward the second axis as the draw string is pulled to a drawn configuration is less than about 3.5 inches.

12. The energy storage portion for a bow of claim 1 wherein the first and second pulleys each rotate around first and second axes, wherein total displacement of the first axis toward the second axis as the draw string is pulled to a drawn configuration is less than about 3.0 inches.

13. The energy storage portion for a bow of claim 1 wherein the first and second pulleys each rotate around first and second axes, wherein a separation between the first and second axes when the draw string is in a drawn configuration is less than about 10 inches.

14. The energy storage portion for a bow of claim 1 wherein the first and second pulleys each rotate around first and second axes, wherein a separation between the first and second axes when the draw string is in a released configuration is less than about 13 inches.

15. The energy storage portion for a bow of claim 1 comprising a finger guards on the center support with a shape corresponding to a space traversed by the draw string as it moves between the drawn configuration and the released configuration.

16. An energy storage portion for a bow comprising:

a center support having a first side and a second side;

at least one first limb having a distal portion pivotally coupled to the first side of the center support at a distal limb mount and aproximal portion pivotally coupled to the first side of the center support at a proximal limb mount;

at least one second limb having a distal portion pivotally coupled to the second side of the center support at a distal limb mount and a proximal portion pivotally coupled to the second side of the center support at a proximal limb mount;

at least one first pulley including a first string journal and a first power cable journal pulley pivotally attached to the first limb at a fixed position located at about a midpoint between the distal and proximal portions;

at least one second pulley including a second string journal and a second power cable journal pivotally attached to the second limb at a fixed position located at about a midpoint between the distal and proximal portions;

a draw string extending across the center support and engaged with the first and second string journals, the draw string including a first end secured to the first pulley and a second end secured to the second pulley;

a first power cable engaged with the first power cable journal having a first end attached to the center support and a second end attached to the first pulley; and a second power cable engaged with the second power cable journal having a first end attached to the center support and a second end attached to the second pulley, wherein the first and second power cables do not cross over the center support from the first side to the second side.

17. The energy storage portion for a bow of claim 16 comprising couplings interposed between at least one of the distal portions or the proximal portions of the first and second limbs and the respective limb mounts that provides limb relief as the draw string is pulled to a drawn configuration.

18. The energy storage portion of a bow of claim 16 wherein the couplings comprise rotating translation arms pivotally attached to one of the distal portions or the proximal portions of the first and second limbs and the respective limb mounts.

19. The energy storage portion for a bow of claim 16 wherein the couplings comprise pivoting couplings, linkage couplings, rotating couplings, sliding couplings, elastomeric couplings, or a combination thereof.

20. The energy storage portion for a bow of claim 16 wherein the center support provides limb relief between the proximal portion and the distal portion of the limbs.

* * * * *